US009708116B2

(12) United States Patent
Koishi et al.

(10) Patent No.: US 9,708,116 B2
(45) Date of Patent: Jul. 18, 2017

(54) PACKING MEMBER AND CARTRIDGE PACKED IN THE PACKING MEMBER

(71) Applicant: CANON KABUSHIKI KAISHA, Tokyo (JP)

(72) Inventors: Isao Koishi, Yokohama (JP); Toshiki Fujino, Tokyo (JP); Tsutomu Sakaguchi, Tokyo (JP); Masayuki Takeuchi, Toda (JP); Taiji Watanabe, Yashio (JP); Kengo Sakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/406,225

(22) PCT Filed: Jun. 7, 2013

(86) PCT No.: PCT/JP2013/066411
§ 371 (c)(1),
(2) Date: Dec. 7, 2014

(87) PCT Pub. No.: WO2013/183794
PCT Pub. Date: Dec. 12, 2013

(65) Prior Publication Data

US 2015/0153708 A1 Jun. 4, 2015

(30) Foreign Application Priority Data

Jun. 8, 2012 (JP) ..... 2012-131296
Oct. 12, 2012 (JP) ..... 2012-227189
Jun. 5, 2013 (JP) ..... 2013-119094

(51) Int. Cl.
*G03G 21/18* (2006.01)
*B65D 85/38* (2006.01)
(Continued)

(52) U.S. Cl.
CPC ..... *B65D 85/38* (2013.01); *B65D 43/16* (2013.01); *B65D 43/162* (2013.01);
(Continued)

(58) Field of Classification Search
CPC .. G03G 21/181; B65D 43/162; B65D 55/024; B65D 81/025; B65D 15/0896
(Continued)

(56) References Cited

U.S. PATENT DOCUMENTS 5,153,643 A 10/1992 Nakakura
5,788,105 A 8/1998 Foos
(Continued)

FOREIGN PATENT DOCUMENTS

CN 1167280 A 12/1997
CN 1172757 A 2/1998
(Continued)

OTHER PUBLICATIONS

Office Action in Taiwanese Patent Application No. 102120330, dated Aug. 28, 2015 (with English Translation).
(Continued)

*Primary Examiner* — Susan Lee
(74) *Attorney, Agent, or Firm* — Fitzpatrick, Cella, Harper & Scinto

(57) ABSTRACT

A packing member for packing a cartridge detachably mountable to an image forming apparatus is molded with a thin resin material plate and includes: (i) a frame portion including an opening as an entrance for the cartridge, a first recessed portion for accommodating the cartridge, and a first limiting portion for limiting a position of the cartridge with respect to a direction perpendicular to a longitudinal direction of the cartridge; and (ii) a cap portion for openably covering the opening. The cap portion includes a second limiting portion for limiting movement of the cartridge,
(Continued)

positionally-limited by the first limiting portion, in a direction in which the cartridge is spaced from the first limiting portion.

50 Claims, 24 Drawing Sheets

(51) Int. Cl.
*B65D 81/02* (2006.01)
*B65D 43/16* (2006.01)
*B65D 55/02* (2006.01)
*G03G 15/08* (2006.01)

(52) U.S. Cl.
CPC ..... *B65D 55/024* (2013.01); *B65D 81/025* (2013.01); *G03G 15/0865* (2013.01); *G03G 21/181* (2013.01); *G03G 21/1803* (2013.01)

(58) Field of Classification Search
USPC ..... 399/111
See application file for complete search history.

(56) References Cited

U.S. PATENT DOCUMENTS

| | | | | |
|---|---|---|---|---|
| 5,871,097 | A * | 2/1999 | Shida | B65D 81/30 206/521 |
| 6,064,842 | A | 5/2000 | Takeuchi et al. | |
| 6,166,096 | A * | 12/2000 | Ichimura | C08J 9/0061 521/134 |
| 6,223,014 | B1 | 4/2001 | Niwano et al. | |
| 6,321,911 | B1 | 11/2001 | Raimer et al. | |
| 6,349,182 | B2 | 2/2002 | Otsubo et al. | |
| 6,408,142 | B1 | 6/2002 | Takeuchi et al. | |
| 6,431,362 | B1 | 8/2002 | Araki et al. | |
| 7,128,211 | B2 | 10/2006 | Nishi et al. | |
| 7,464,520 | B2 | 12/2008 | Nishi et al. | |
| 7,593,670 | B2 | 9/2009 | Matsuda et al. | |
| 7,681,379 | B2 | 3/2010 | Nishi et al. | |
| 8,116,660 | B2 | 2/2012 | Watanabe | |
| 8,670,690 | B2 * | 3/2014 | Jang | G03G 21/1825 399/111 |
| 2004/0232031 | A1 | 11/2004 | Nishi et al. | |
| 2006/0045562 | A1 * | 3/2006 | Choi | G03G 15/0868 399/103 |
| 2007/0045317 | A1 | 3/2007 | Rosender et al. | |
| 2009/0074472 | A1 | 3/2009 | Kwon | |
| 2014/0064776 | A1 | 3/2014 | Yamasaki et al. | |
| 2014/0064784 | A1 * | 3/2014 | Hayashi | G03G 21/181 399/111 |
| 2014/0241736 | A1 * | 8/2014 | Shinoya | G03G 21/1832 399/111 |
| 2014/0321883 | A1 * | 10/2014 | Nakazawa | G03G 21/1676 399/119 |
| 2014/0361030 | A1 | 12/2014 | Toba et al. | |
| 2015/0114870 | A1 | 4/2015 | Fujino et al. | |

FOREIGN PATENT DOCUMENTS

| | | | | |
|---|---|---|---|---|
| EP | 0 758 105 | A1 | | 2/1997 |
| JP | H01-244489 | A | | 9/1989 |
| JP | H04-114173 | A | | 4/1992 |
| JP | H05-232752 | A | | 9/1993 |
| JP | H06-186895 | A | | 7/1994 |
| JP | 60-56050 | | | 9/1995 |
| JP | H10-029616 | A | | 2/1998 |
| JP | H11-249533 | A | | 9/1999 |
| JP | H11-288155 | A | | 10/1999 |
| JP | 2000-199995 | A | | 7/2000 |
| JP | 2000-313481 | A | | 11/2000 |
| JP | 2001199477 | A | * | 7/2001 |
| JP | 2004-205793 | A | | 7/2004 |
| JP | 2004-299713 | A | | 10/2004 |
| JP | 2004-338785 | A | | 12/2004 |
| JP | 3639834 | B2 | | 4/2005 |
| JP | 2005-153981 | A | | 6/2005 |
| JP | 2008-280049 | A | | 11/2008 |
| JP | 2009-069823 | A | | 4/2009 |
| JP | 2010-049039 | A | | 3/2010 |
| JP | 2011-022372 | A | | 2/2011 |
| JP | 2011-121594 | A | | 6/2011 |
| JP | 2011-162252 | A | | 8/2011 |

OTHER PUBLICATIONS

International Search Report and Written Opinion of the International Search Authority in Application No. PCT/JP2013/066411.
Office Action in Chinese Patent Application No. 201380029712.X, mailed Dec. 29, 2015 (with English translation).
Office Action in Korean Patent Application No. 10-2014-7036924, mailed Apr. 1, 2016.
Oct. 3, 2016 Office Action in Korean Patent Application No. 10-2016-7017757.
Aug. 30, 2016 Office Action in Japanese Patent Application No. 2012-227189.
Nov. 15, 2016 Official Communication in European Patent Application No. 13 735 083.1.
Feb. 14, 2017 Office Action in Japanese Patent Application No. 2013-119094.
Official Communication in European Patent Application No. 13 735 083.1, issued Apr. 11, 2017.

* cited by examiner (a)

(b)

PACKING MEMBER AND CARTRIDGE PACKED IN THE PACKING MEMBER

TECHNICAL FIELD

The present invention relates to a packing member for packing a cartridge detachably mountable to an image forming apparatus and relates to the cartridge packed in the packing member.

Examples of the image forming apparatus may include an electrophotographic copying machine, an electrophotographic printer (e.g., a laser beam printer, an LED printer or the like), a facsimile machine, a word processor, and the like. Further, the cartridge includes, e.g., an electrophotographic photosensitive member as an image bearing member, or is a cartridge prepared by integrally assembling the electrophotographic photosensitive member with a developing means acting on the electrophotographic photosensitive member into a unit, which is detachably mountable to the image forming apparatus.

Further, the packing member is used for protecting the cartridge from external vibration and impact when the cartridge is transported.

BACKGROUND ART

An electrophotographic image forming apparatus, such as a printer, using an electrophotographic process electrically charges uniformly the electrophotographic photosensitive member as the image bearing member and then forms a latent image by selective exposure of the electrophotographic photosensitive member to light. Then, the latent image is developed with the developer to be visualized as a developer image. The developer image is then transferred onto a recording material (medium).

By applying heat and pressure to the transferred developer image, the developer image is fixed on the recording material, so that an image is recorded.

Such a conventional electrophotographic image forming apparatus was accompanied with supply of the developer and maintenance of various process devices.

As a means for facilitating such a developer supplying operation and maintenance, all or a part of the electrophotographic photosensitive image, a charging means, the developing means, a cleaning means and the like are integrally assembled, as a process cartridge, in a frame. A process cartridge type in which the process cartridge is detachably mountable to the electrophotographic image forming apparatus is employed.

According to the process cartridge type, the maintenance of the process cartridge can be performed in the form of replacement by a user himself (herself), and therefore it was possible to remarkably improve productivity. With respect to such a detachably mountable, the user replaces the cartridge. In this case, in general, the cartridge is taken out from an electrophotographic image forming apparatus main assembly and then is replaced with a new cartridge.

Here, the fresh cartridge shipped from a manufacturing factory is packed in the packing member for protecting the cartridge from vibration and impact during transportation. Further, at the time when the new cartridge is mounted in the apparatus main assembly, the packing member is unpacked and then a grip portion of the cartridge is griped to take out the cartridge from the packing member. Then, the cartridge is mounted in the apparatus main assembly.

As the packing member for packing the cartridge and for protecting the cartridge from the vibration and impact during transportation, various packing members as described in Japanese Patent No. 3639834 and Japanese Laid-Open Patent Application (JP-A) Hei 4-114173.

Of these packing members, according to a constitution in JP-A Hei 4-114173, the packing member is a member prepared by extrusion (molding) along an outer configuration of the cartridge. The packing member is provided with many projections and recesses, by which the cartridge is supported. Further, openings at end portions of the packing member are covered with a cap (cover) molded correspondingly to the outer configuration of the cartridge.

However, constitutions of Japanese Patent No. 3639834 and JP-A Hei 4-114173 involve the following problem.

In order to fix the cartridge relative to the packing member, at each of end portions of the electrophotographic photosensitive member of the cartridge with respect to an axial direction of the photosensitive member, a cap as a separate member is provided, so that positional limitation of the cartridge with respect to the axial direction is made. For that reason, the constitution of the packing member complicated, and a cost was increased. Further, when the cartridge is taken out from the packing member, the cap of the packing member is slid from a side-surface opening of the packing member in the axial direction, thus being separated from the packing member. Then, the cartridge is slid in the axial direction, and thus is taken out from the packing member. That is, in order for the user to take out the cartridge from the packing member, complicate steps are required to be performed.

SUMMARY OF THE INVENTION

A principal object of the present invention is to provide a packing member capable of protecting a cartridge from vibration and impact during transportation.

Another object of the present invention is to provide the cartridge packed in the packing member.

According to an aspect of the present invention, there is provided a packing member for packing a cartridge detachably mountable to an image forming apparatus, wherein the packing member is molded with a thin resin material plate and comprises: (i) a frame portion including an opening as an entrance for the cartridge, a first recessed portion for accommodating the cartridge, and a first limiting portion for limiting a position of the cartridge with respect to a direction perpendicular to a longitudinal direction of the cartridge; and (ii) a cap portion for openably covering the opening, wherein the cap portion includes a second limiting portion for limiting movement of the cartridge, positionally-limited by the first limiting portion, in a direction in which the cartridge is spaced from the first limiting portion.

According to another object of the present invention, there is provided a cartridge packed in a packing member and detachably mountable to an image forming apparatus, wherein the packing member is molded with a thin resin material plate and comprises: (i) a frame portion including an opening as an entrance for the cartridge, a first recessed portion for accommodating the cartridge, and a first limiting portion for limiting a position of the cartridge with respect to a direction perpendicular to a longitudinal direction of the cartridge; and (ii) a cap portion for openably covering the opening, wherein the cap portion includes a second limiting portion for limiting movement of the cartridge, positionally-limited by the first limiting portion, in a direction in which the cartridge is spaced from the first limiting portion, wherein the cartridge is positionally limited by the first limiting portion and the second limiting portion in a state in which the cap portion is mounted on the frame portion so as to cover the opening.

These and other objects, features and advantages of the present invention will become more apparent upon a consideration of the following description of the preferred embodiments of the present invention taken in conjunction with the accompanying drawings.

Figure 4:
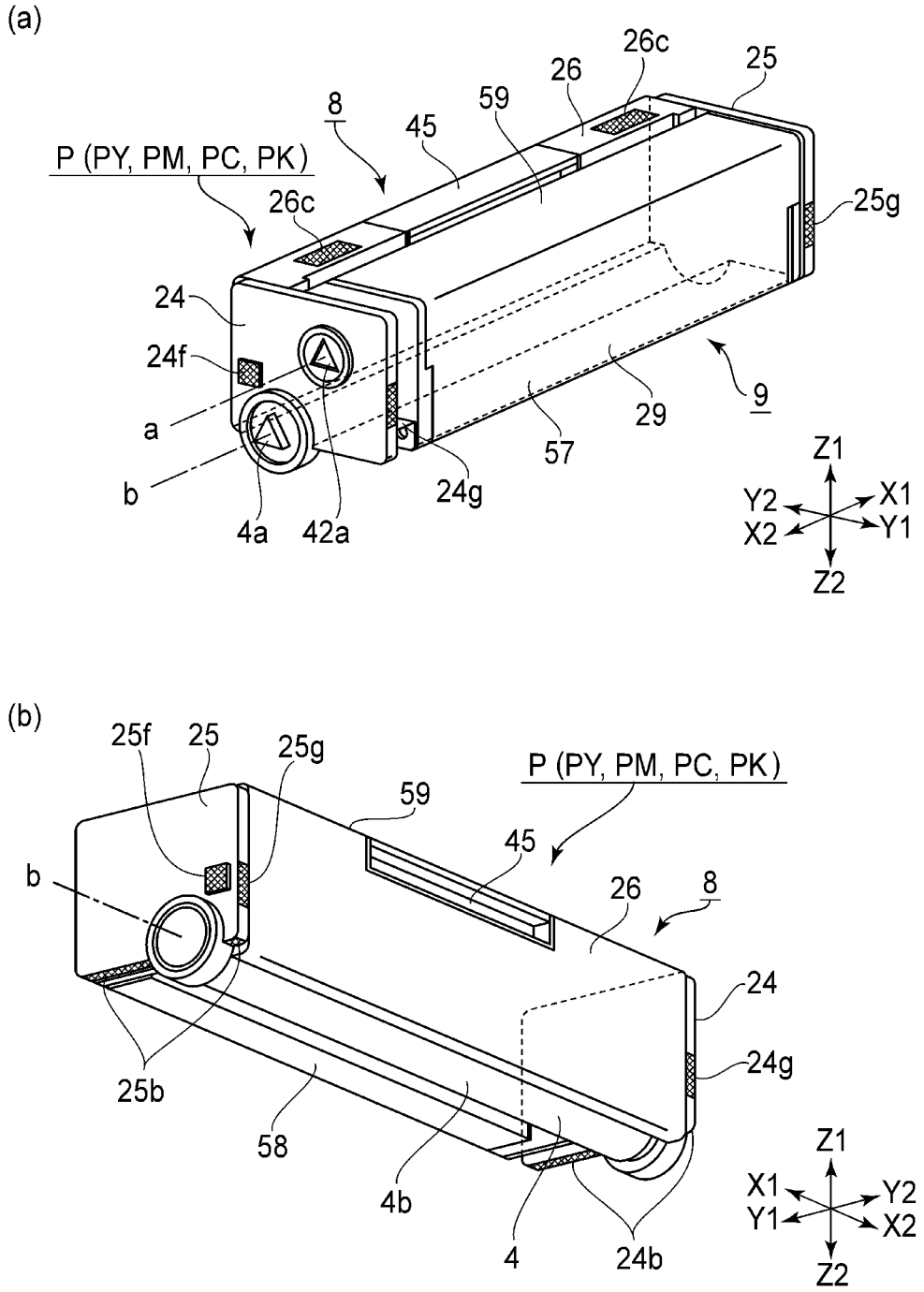

Parts (a) and (b) of FIG. 4 are schematic perspective views each showing the cartridge in Embodiment 1.

Figure 5:
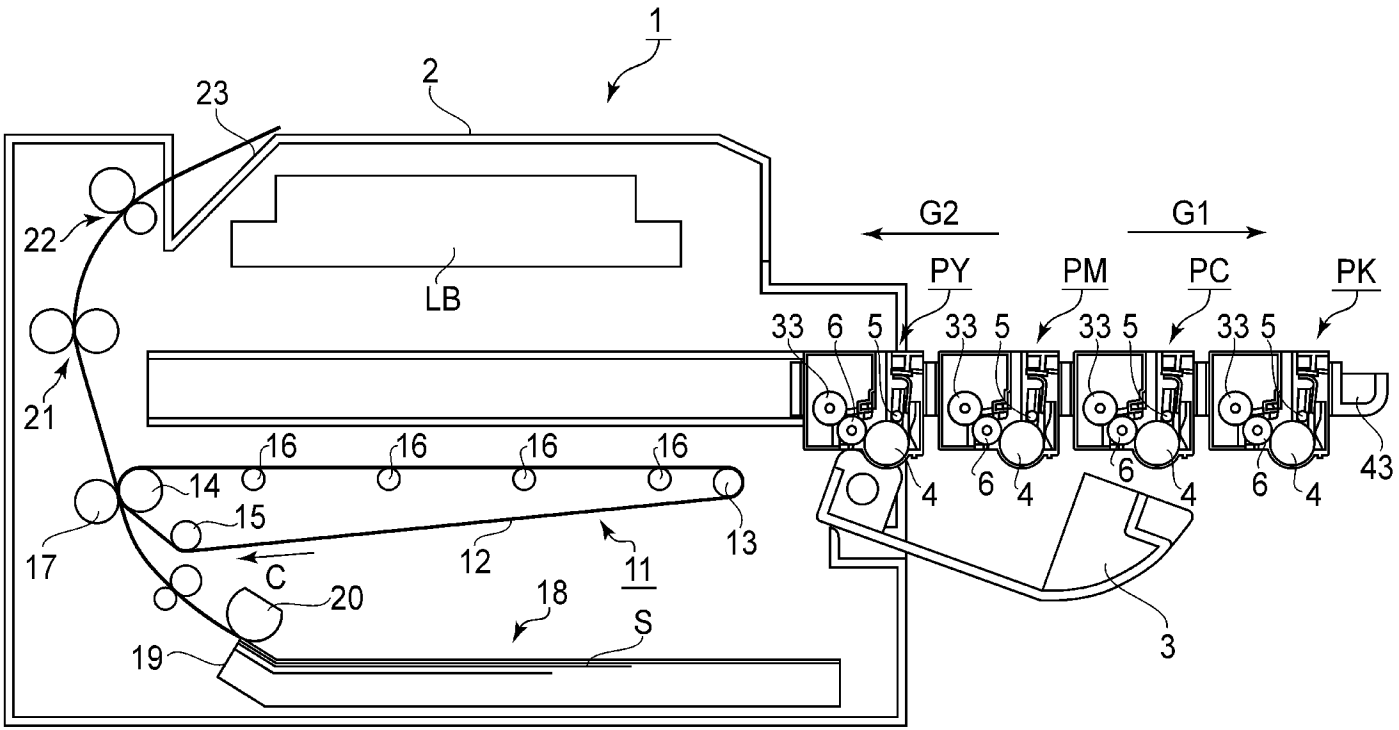

FIG. 5 is a schematic sectional view showing an image forming apparatus in Embodiment 1.

Figure 6:
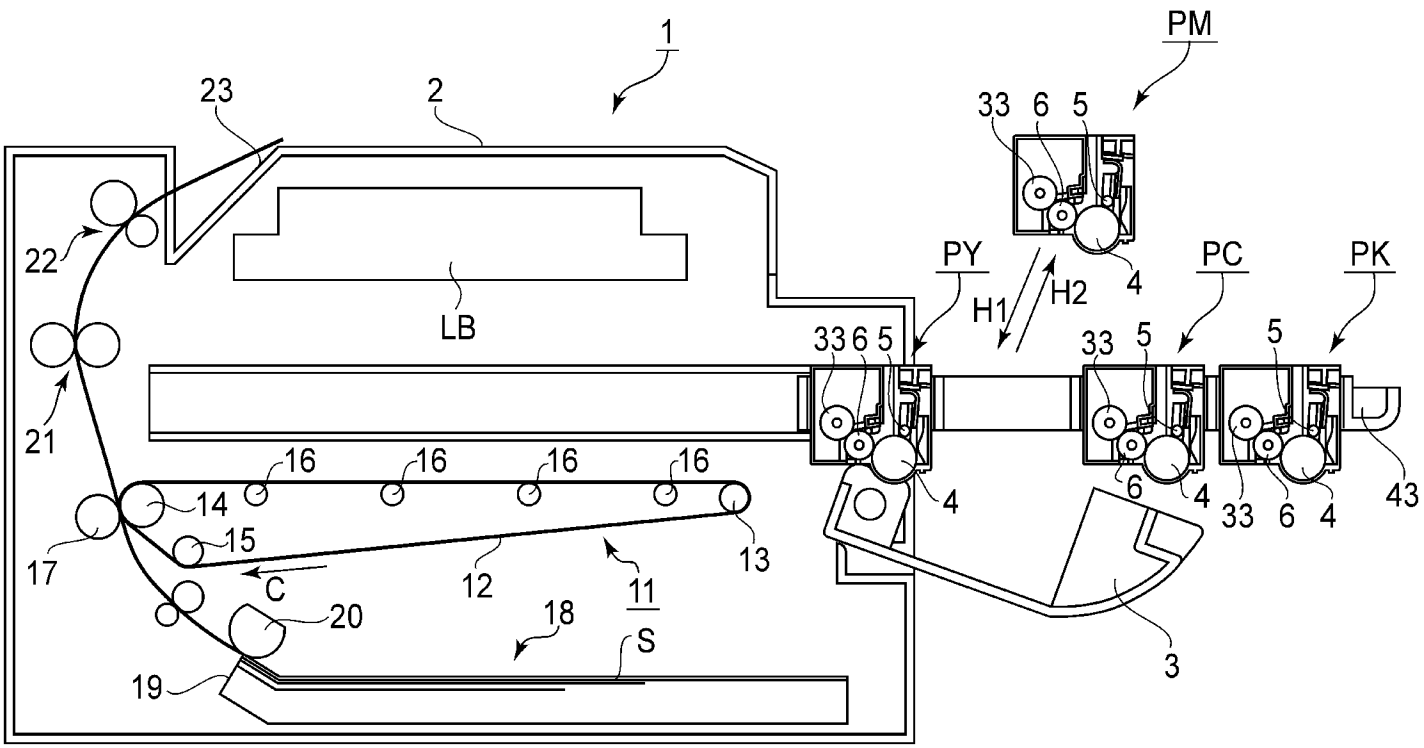

FIG. 6 is a schematic sectional view showing an operation in which the cartridge is demounted from and mounted in a cartridge tray in Embodiment 1.

Figure 7:
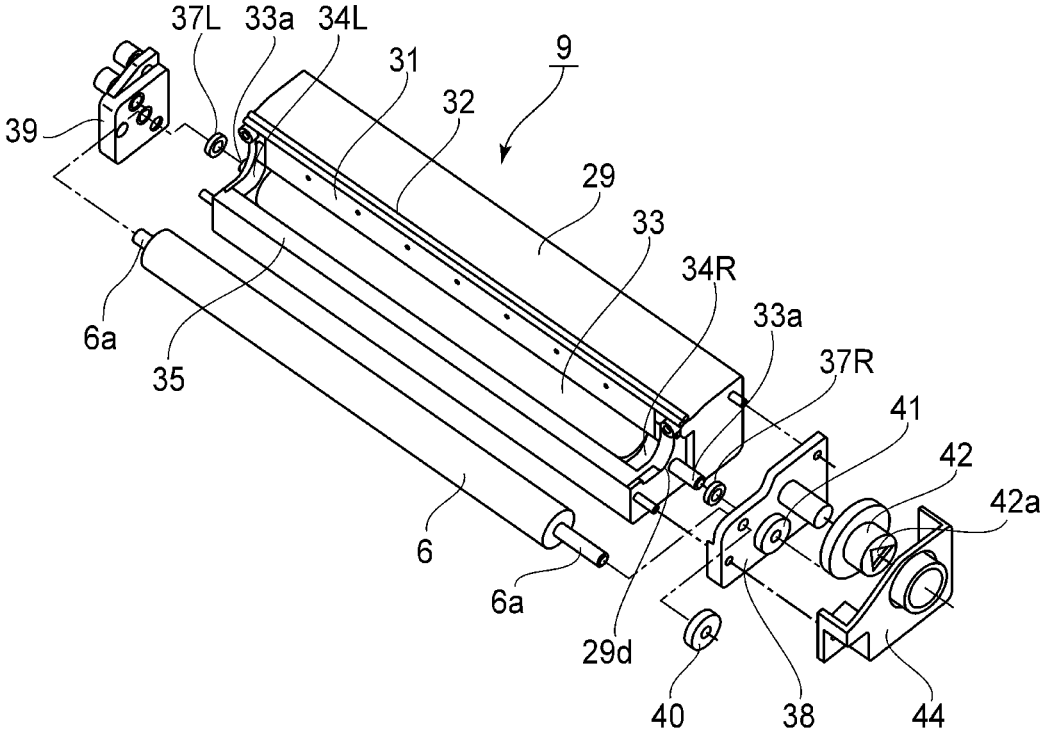

FIG. 7 is a schematic perspective view showing a developing device in Embodiment 1.

Figure 8:
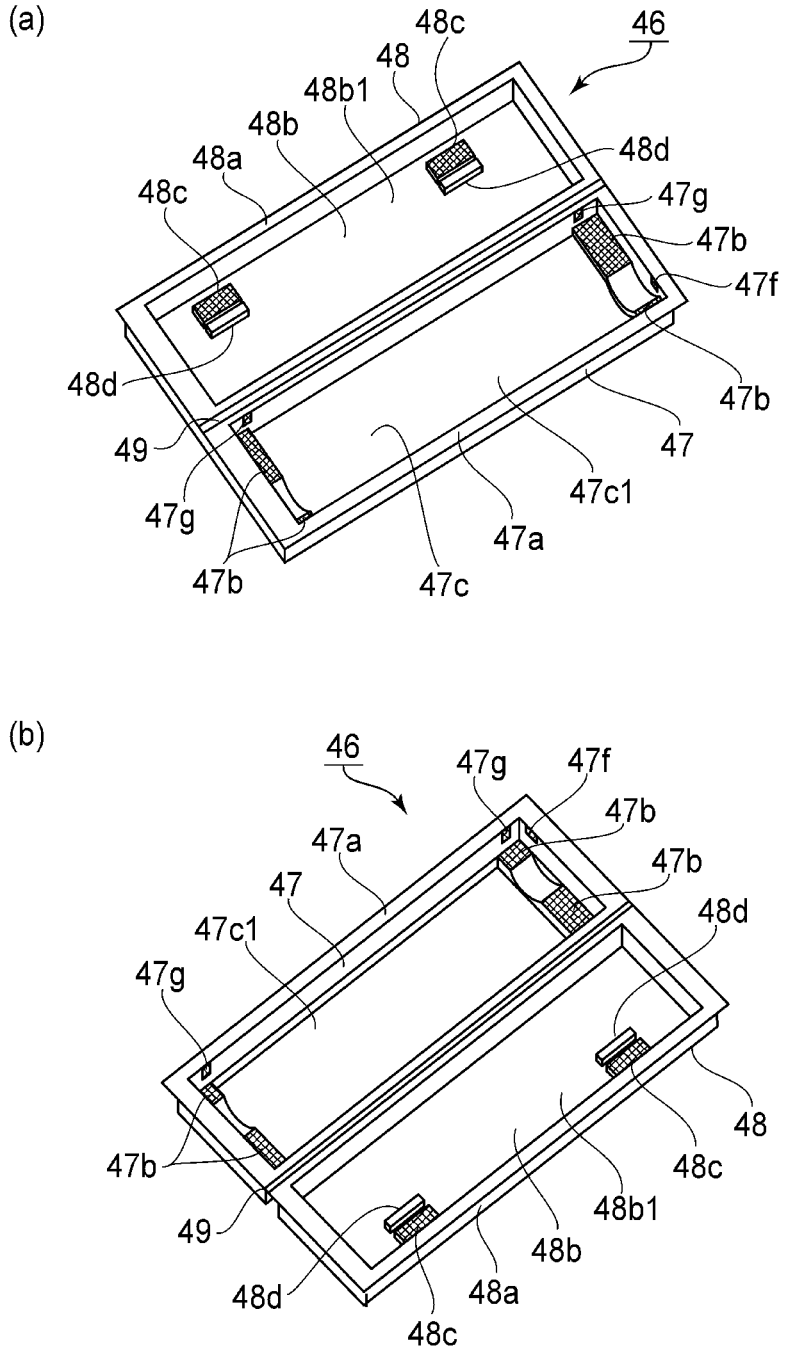

Parts (a) and (b) of FIG. 8 are schematic perspective views each showing the packing member in Embodiment 1.

Figure 9:
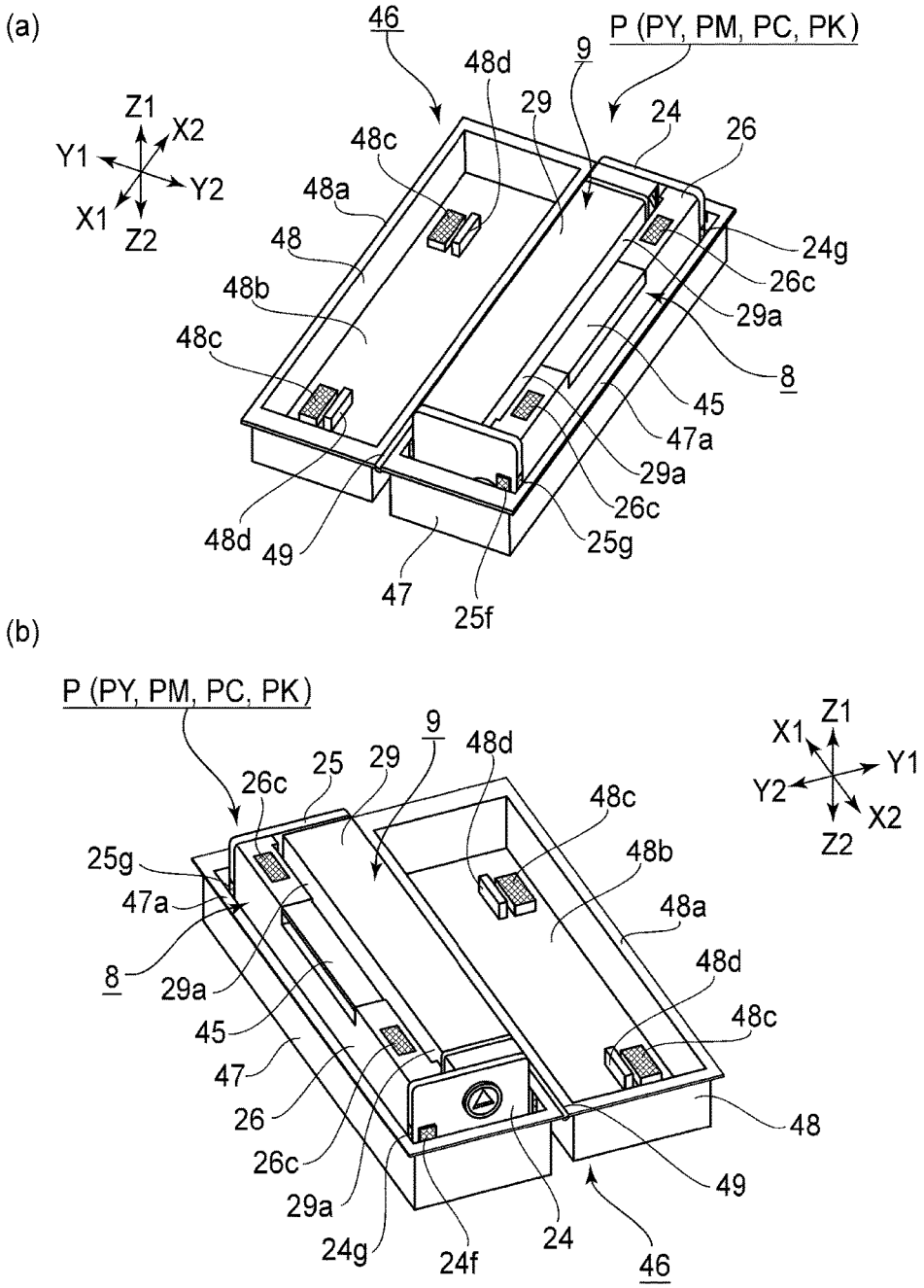

Parts (a) and (b) of FIG. 9 are schematic perspective views each showing a state in which the cartridge is detachably from the packing member in Embodiment 1.

Figure 10:
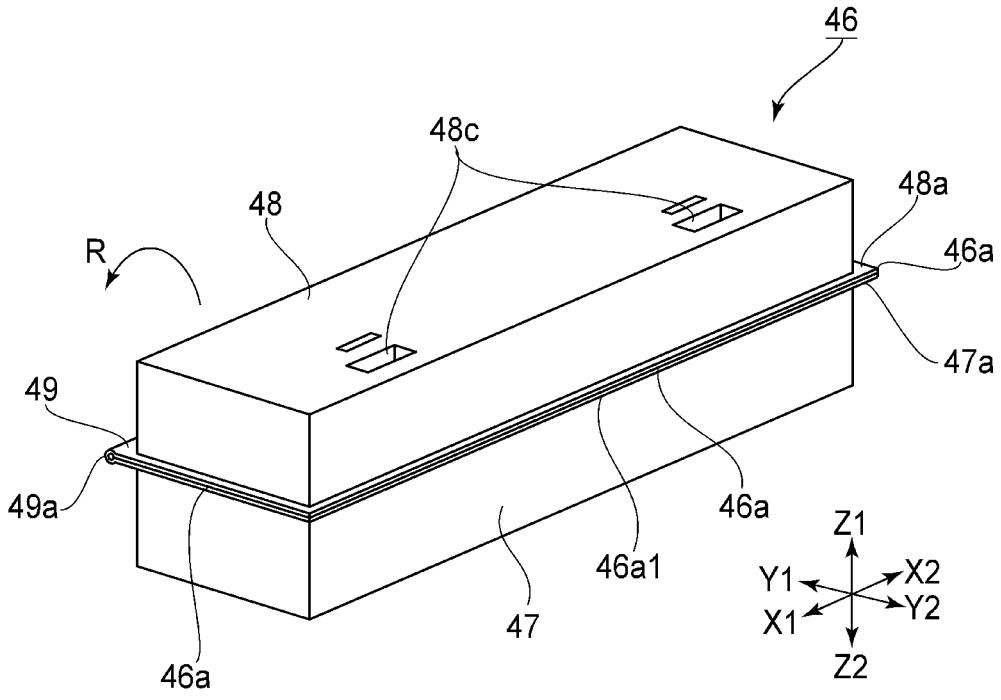

FIG. 10 is a schematic perspective view showing the packing member in Embodiment 1.

Figure 11:
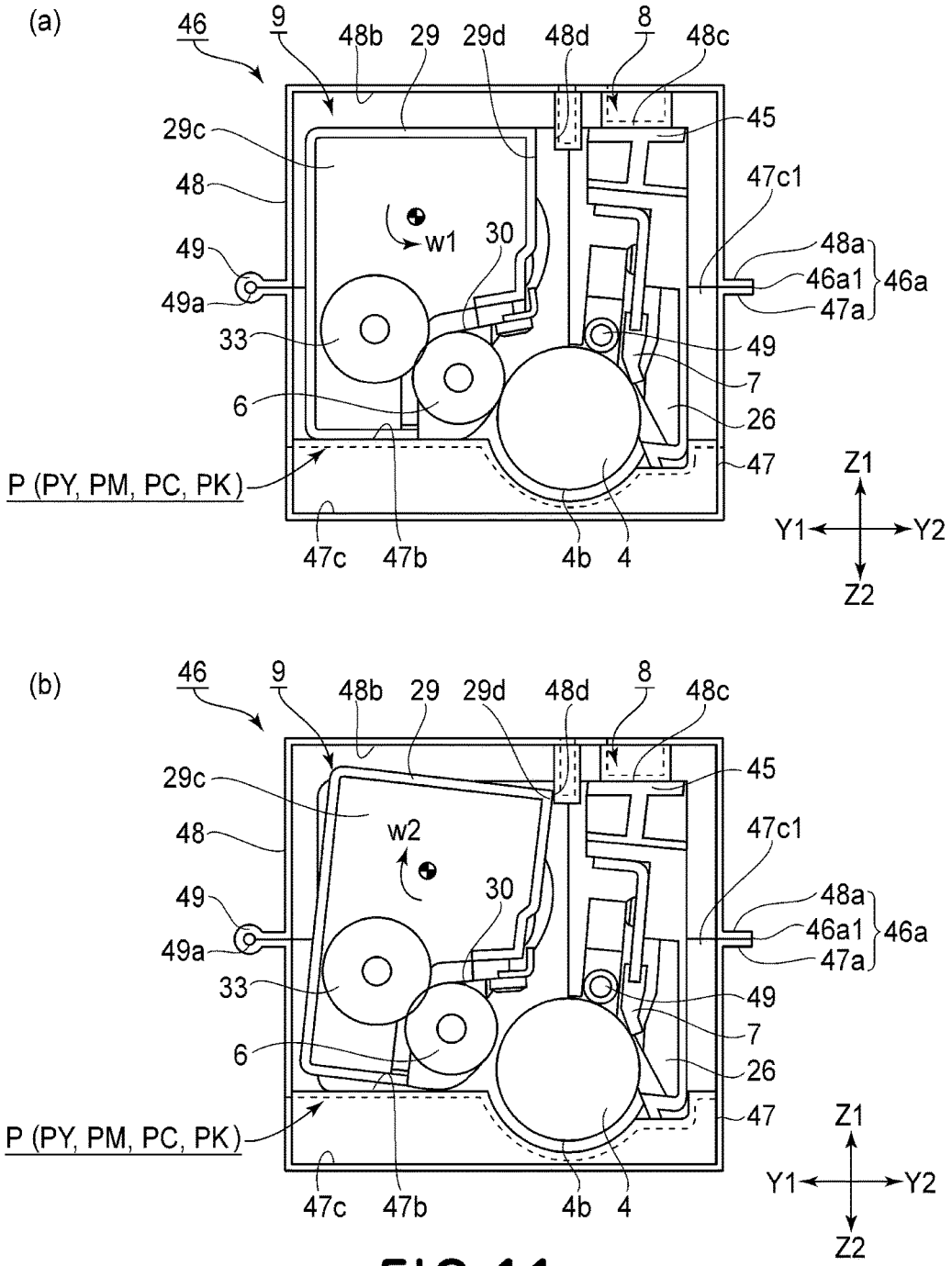

Parts (a) and (b) of FIG. 11 are schematic sectional views each showing the packing member in which the cartridge is packed in Embodiment 1.

Figure 12:
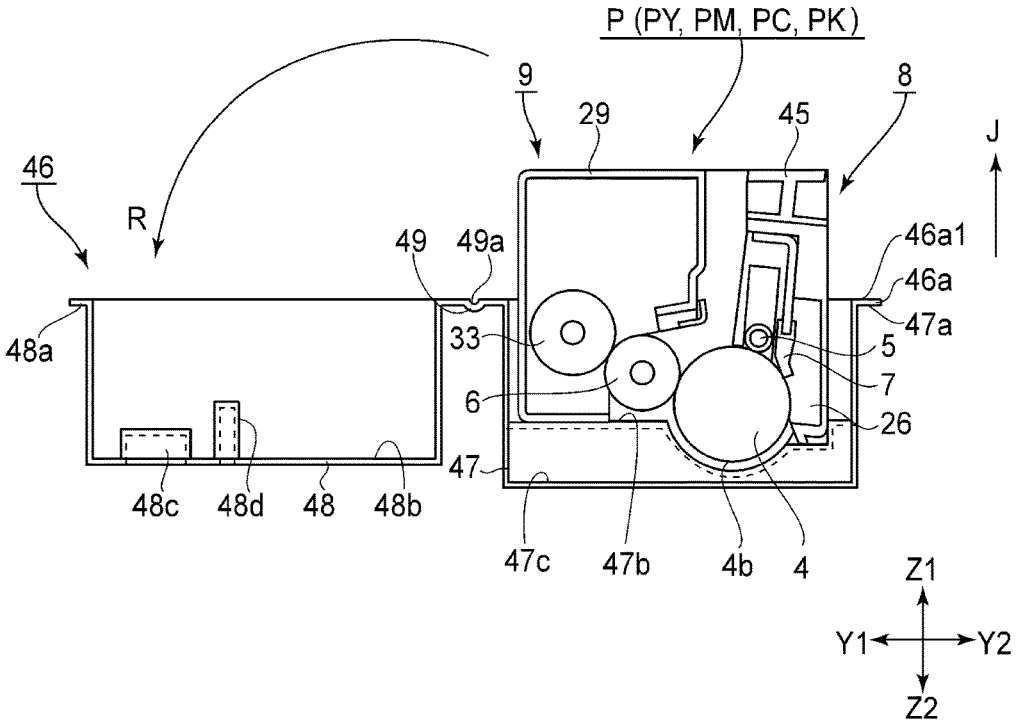

FIG. 12 is a schematic sectional view showing an unpacked state of the packing member in which the cartridge is packed in Embodiment 1.

Figure 13:
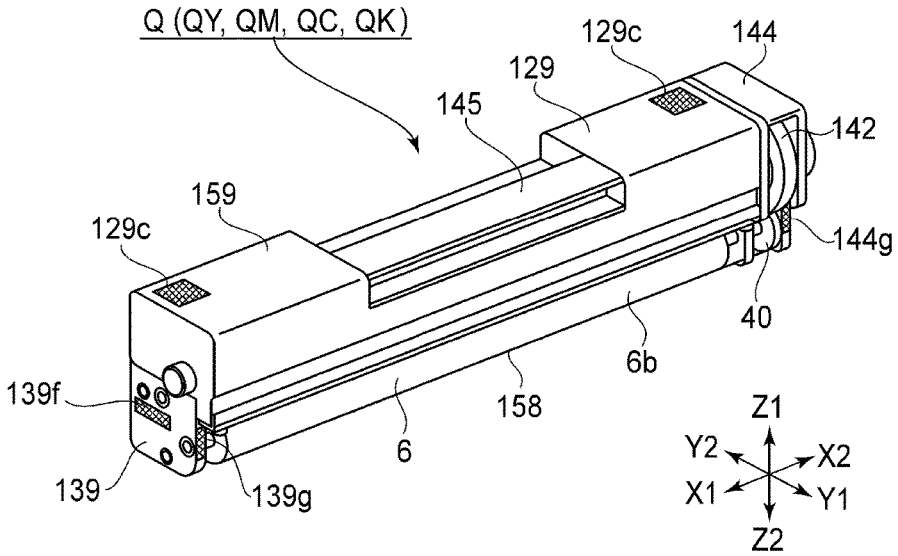
Figure 13:
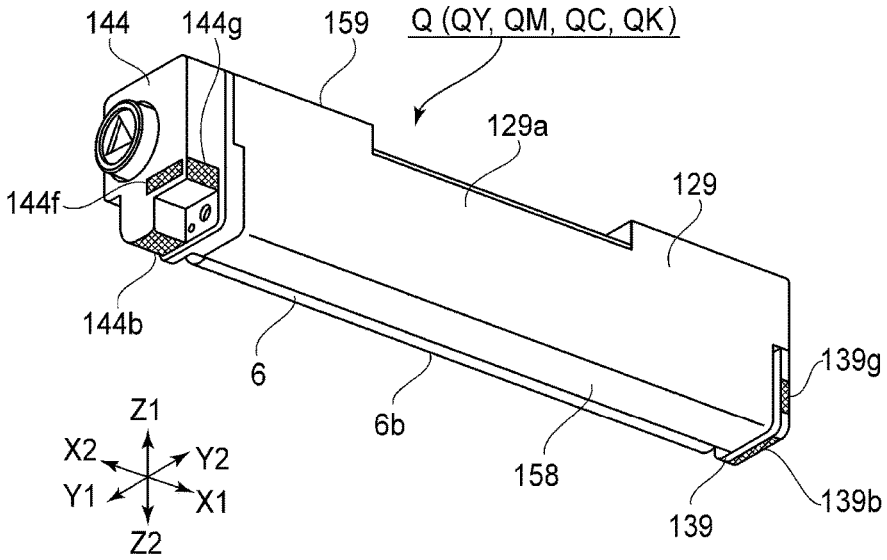

Parts a) and (b) of FIG. 13 are schematic perspective views each showing a developing device in Embodiment 2.

Figure 14:
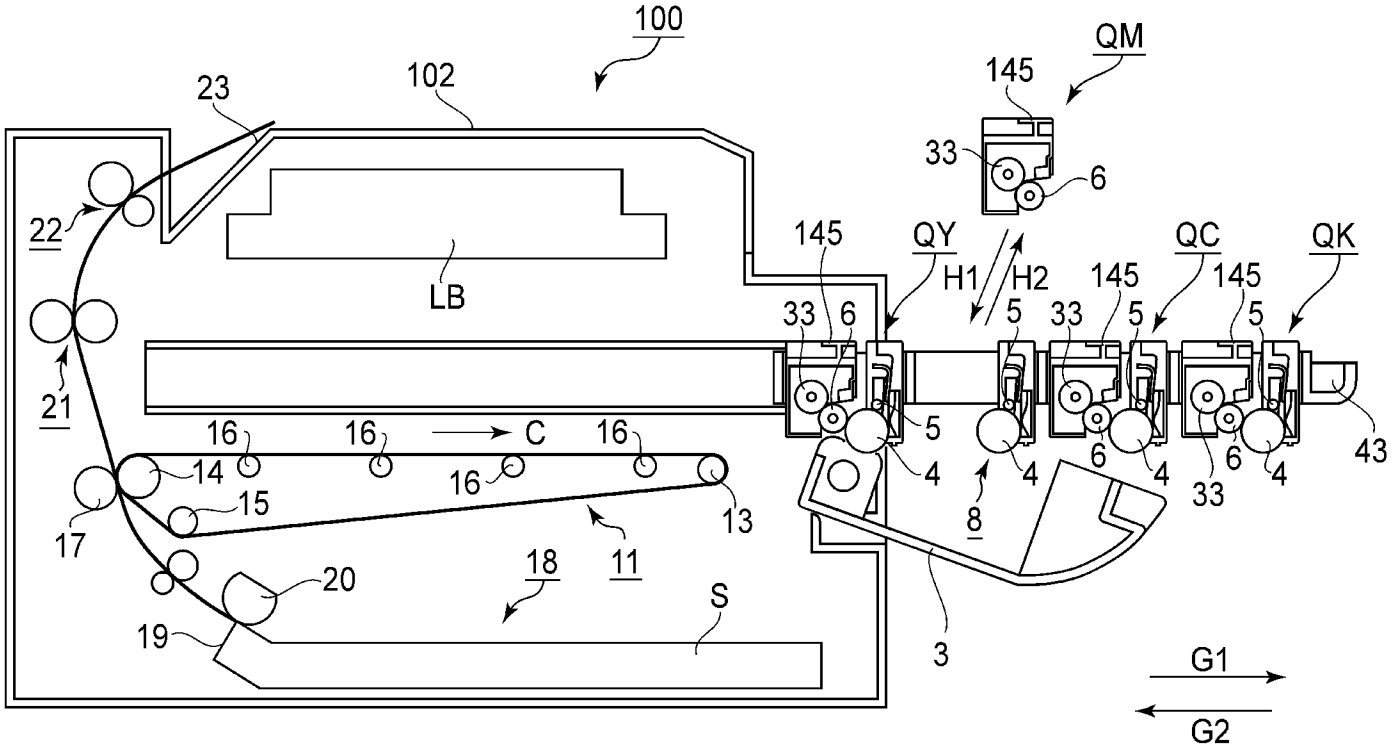

FIG. 14 is a schematic sectional view showing a state in which the developing device is detachably mountable to the apparatus main assembly in Embodiment 2.

Figure 15:
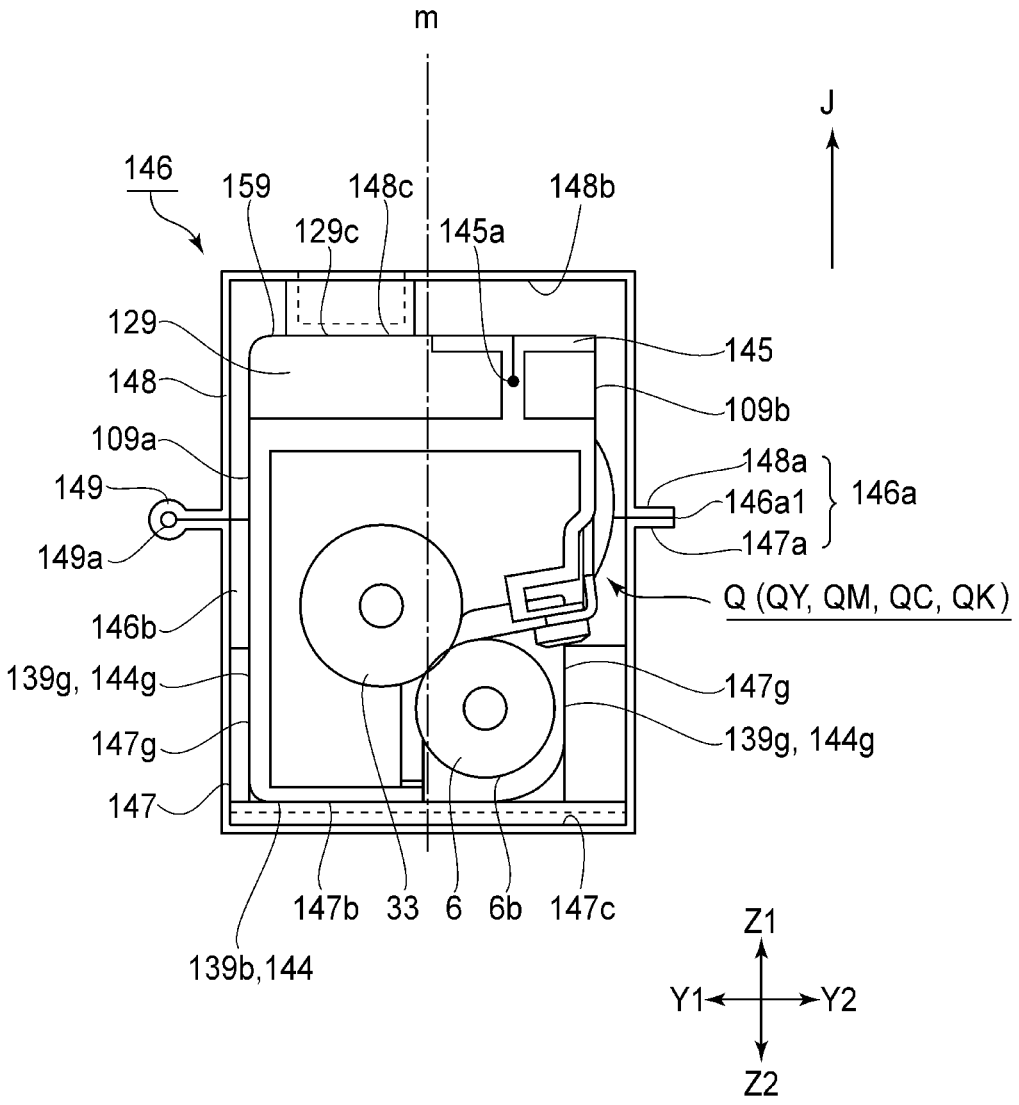

FIG. 15 is a schematic sectional view showing a packing member in which the developing device is packed in Embodiment 2.

Figure 16:
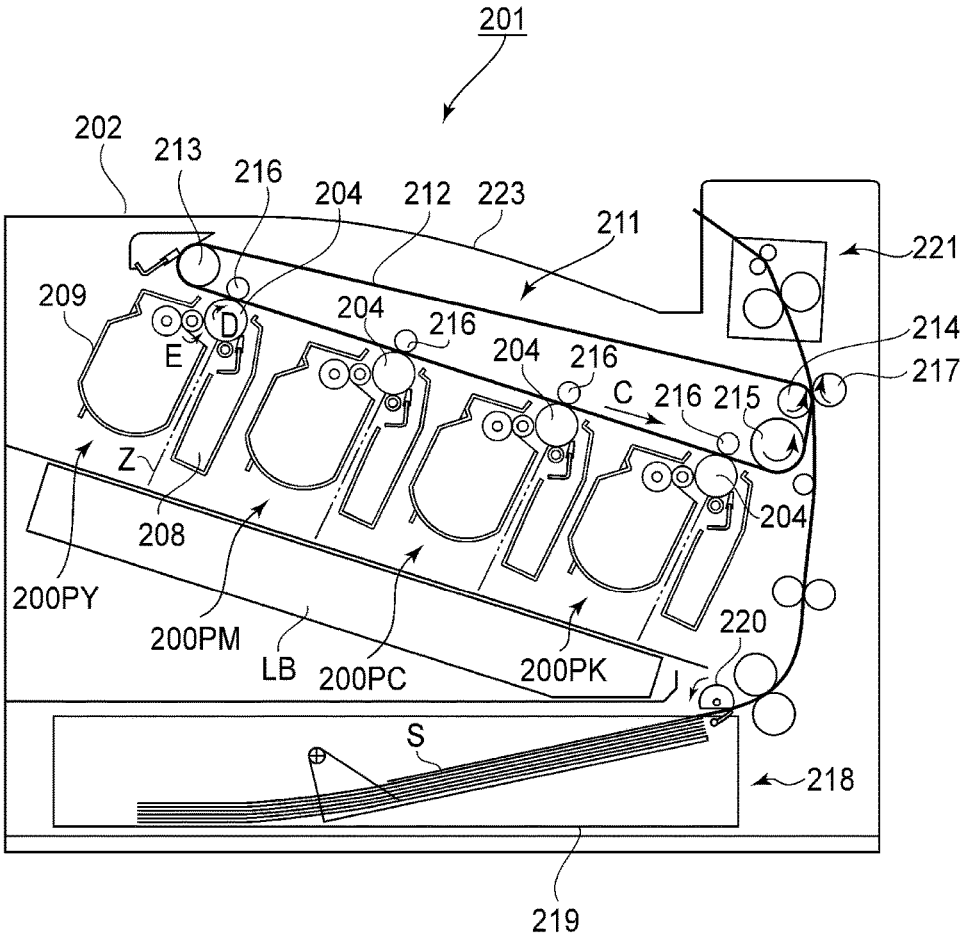

FIG. 16 is a schematic sectional view showing an image forming apparatus main assembly in Embodiment 3.

Figure 17:
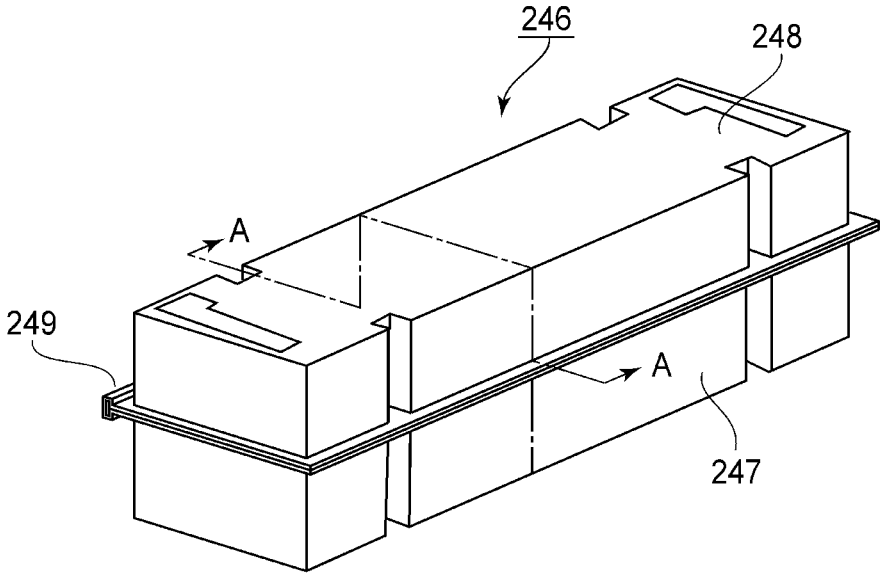

FIG. 17 is a schematic perspective view showing a packing member in Embodiment 3.

Figure 18:
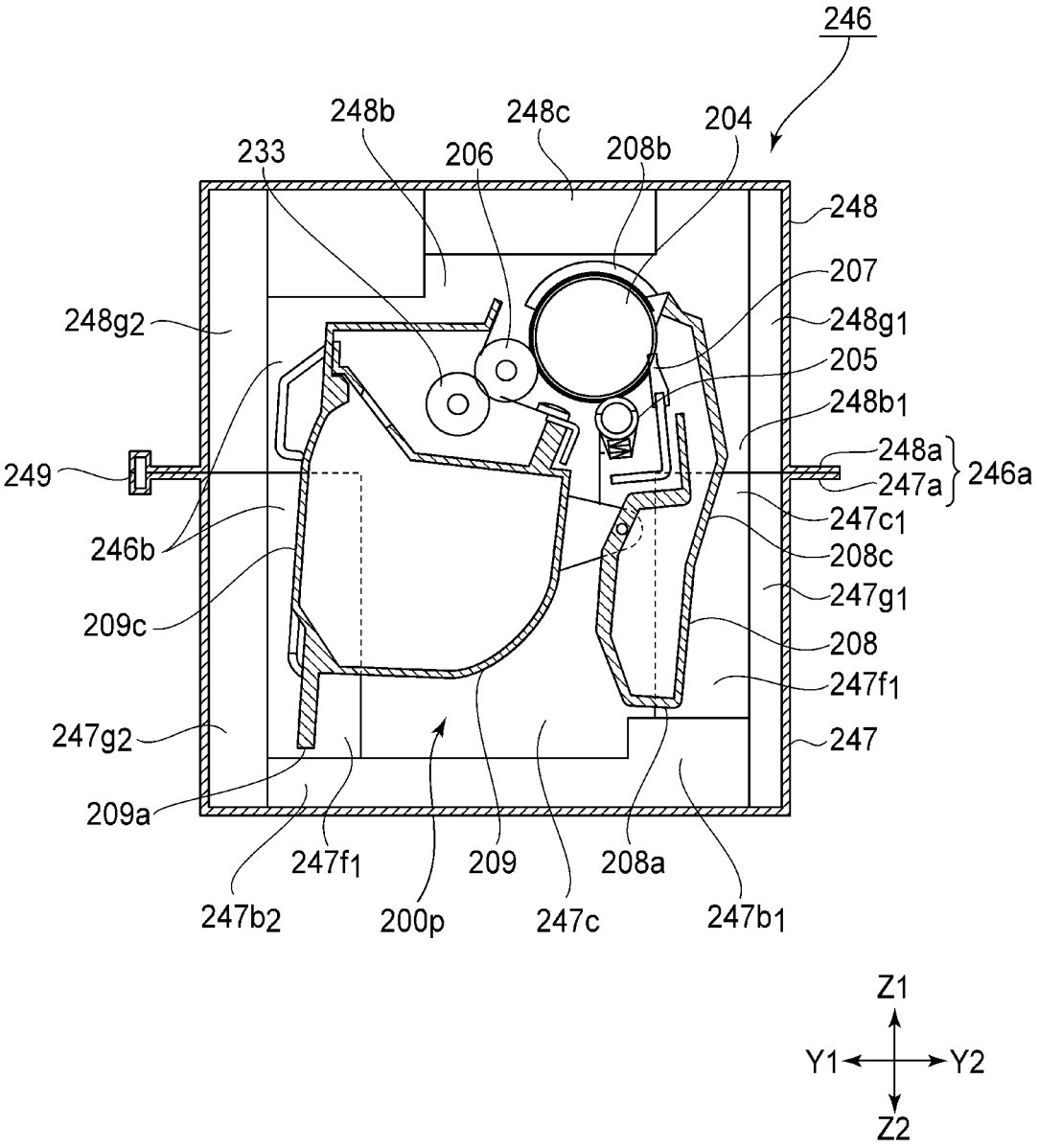

FIG. 18 is a schematic sectional view showing the packing member in which a cartridge is packed in Embodiment 3.

Figure 19:
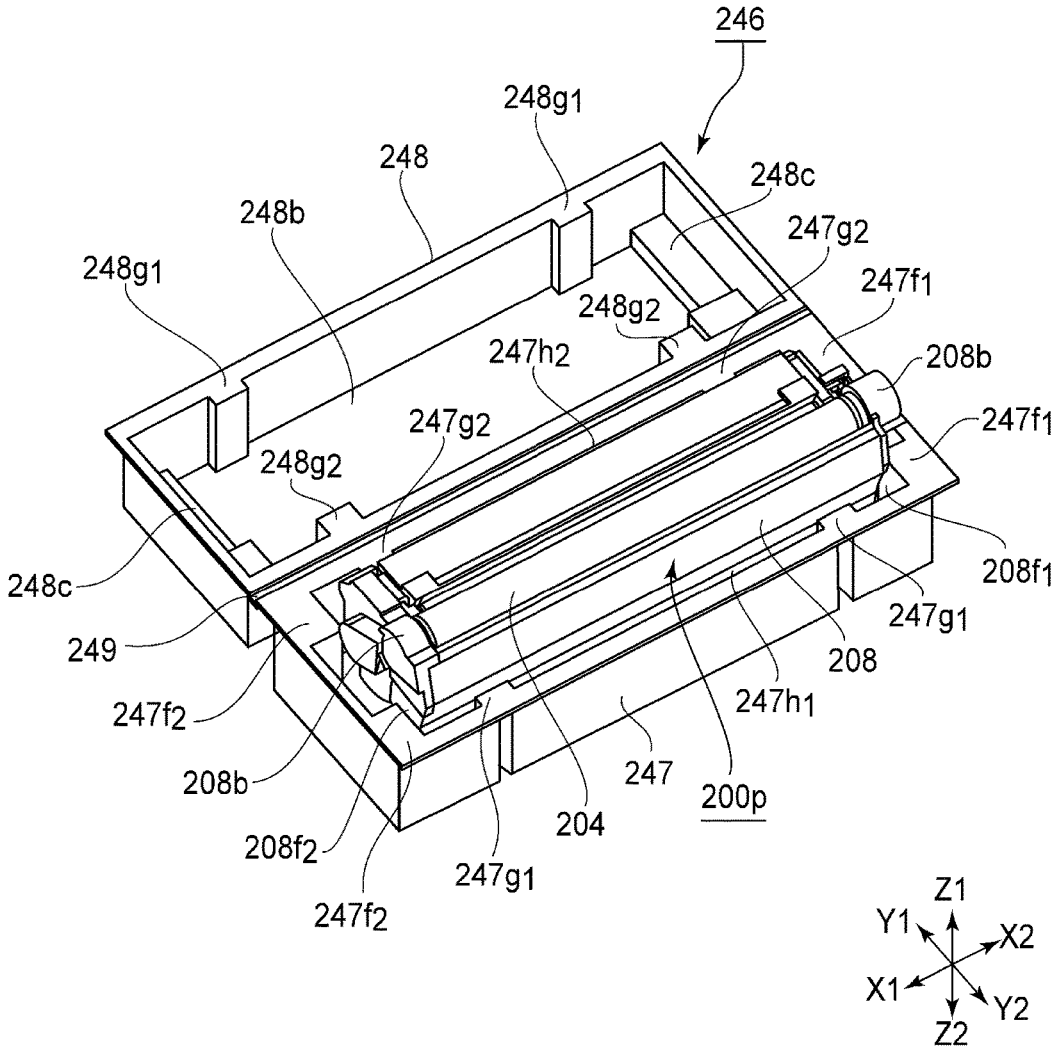
Figure 20:
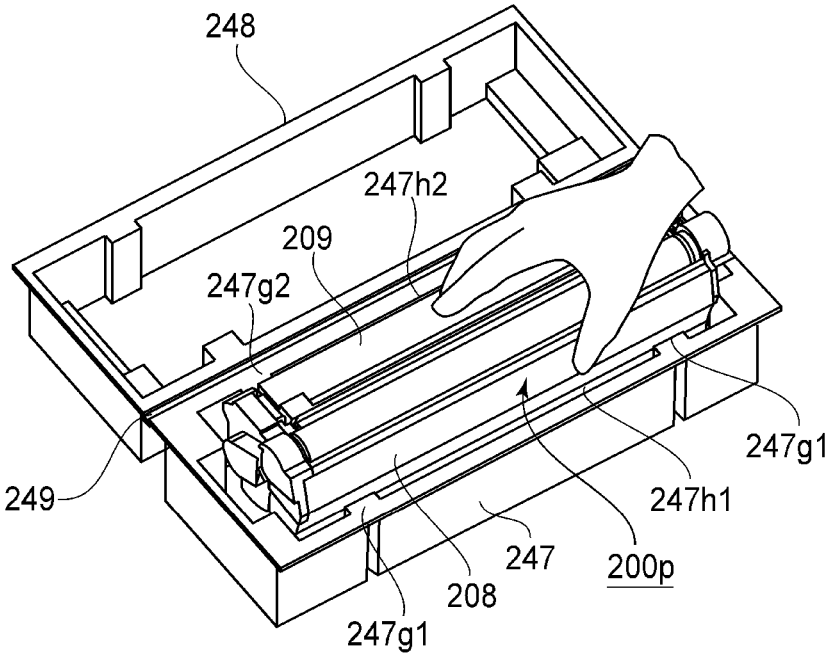

FIGS. 19 and 20 are schematic perspective views each showing an unpacked state of the packing member in Embodiment 3.

Figure 21:
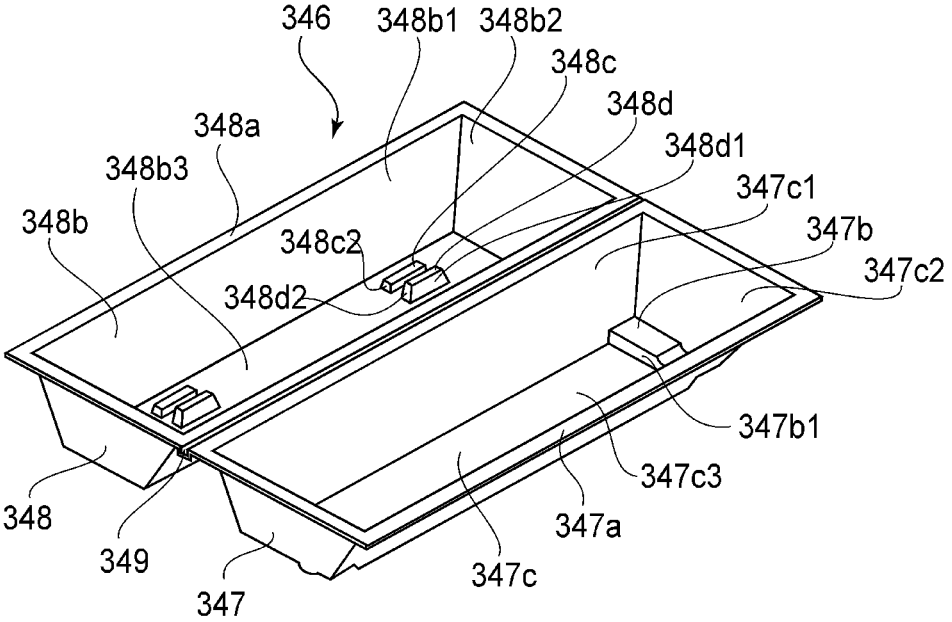
Figure 22:
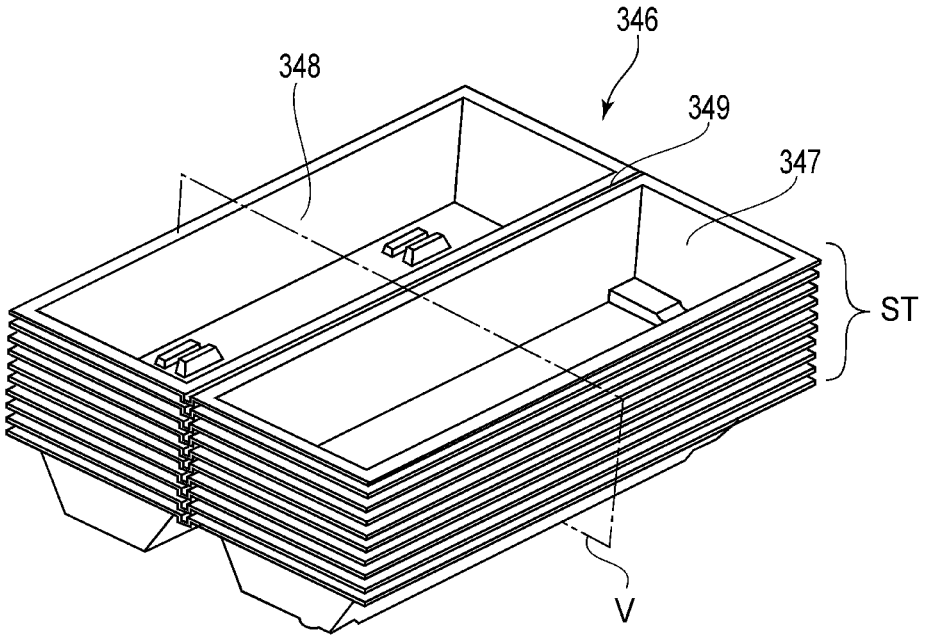

FIGS. 21 and 22 are schematic perspective views each showing a packing member in Embodiment 4.

Figure 23:
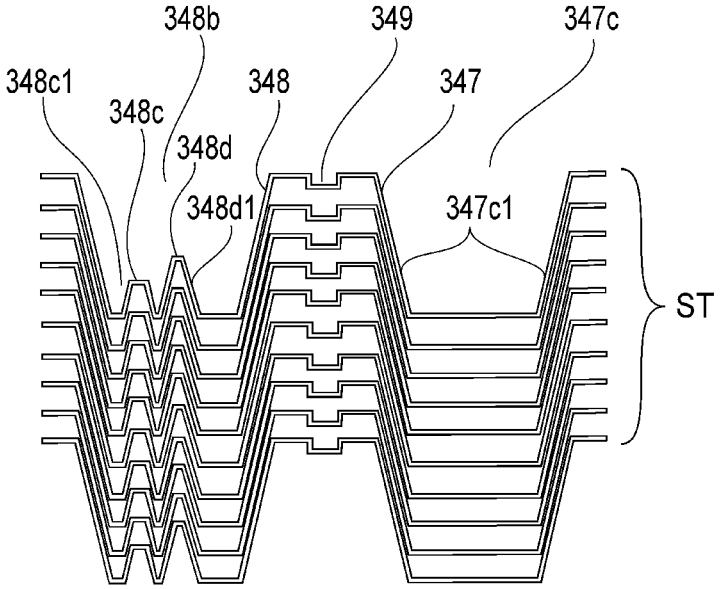

FIG. 23 is a schematic sectional view showing packing members in Embodiment 4.

Figure 24:
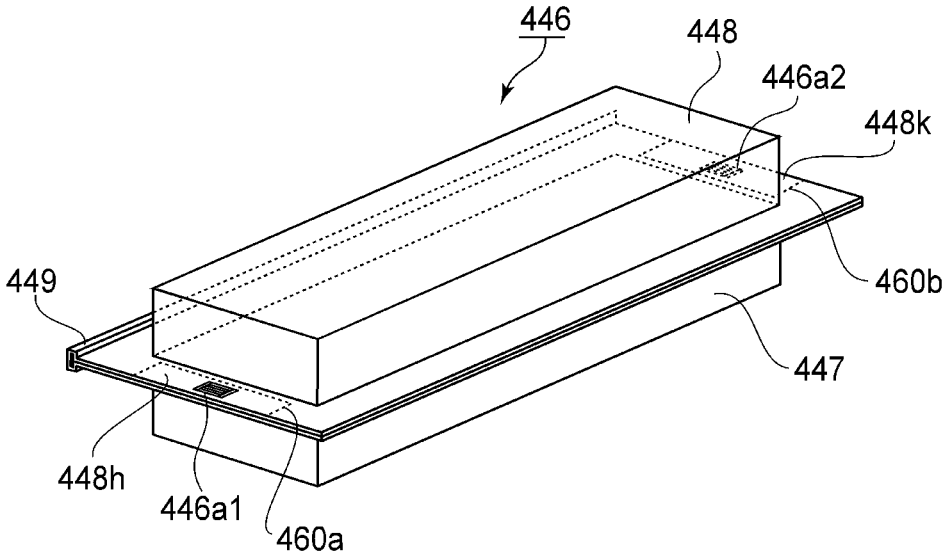

FIG. 24 is a schematic perspective view showing a packing member in Embodiment 5.

Figure 25:
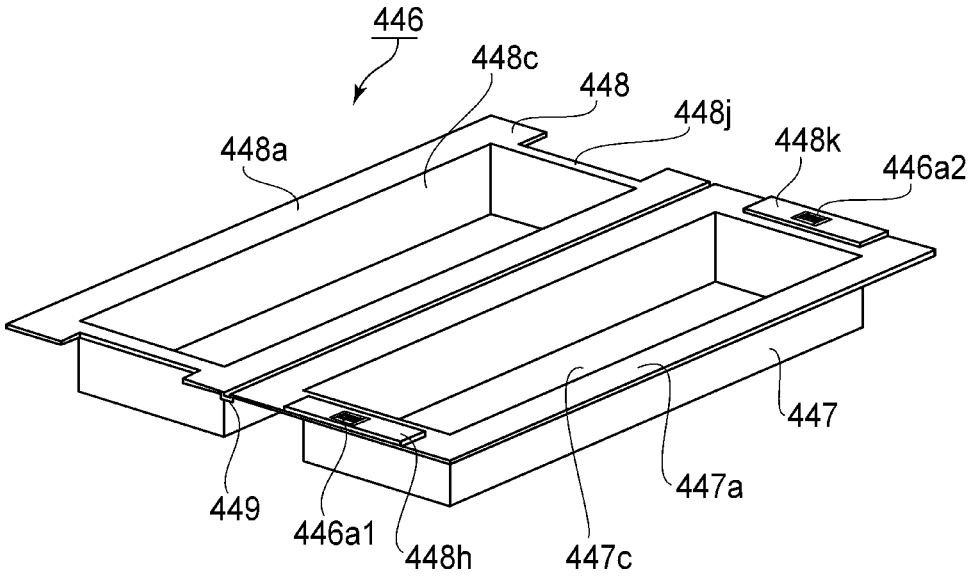

FIG. 25 is a schematic perspective view showing an unpacked state of the packing member in Embodiment 5.

Figure 26:
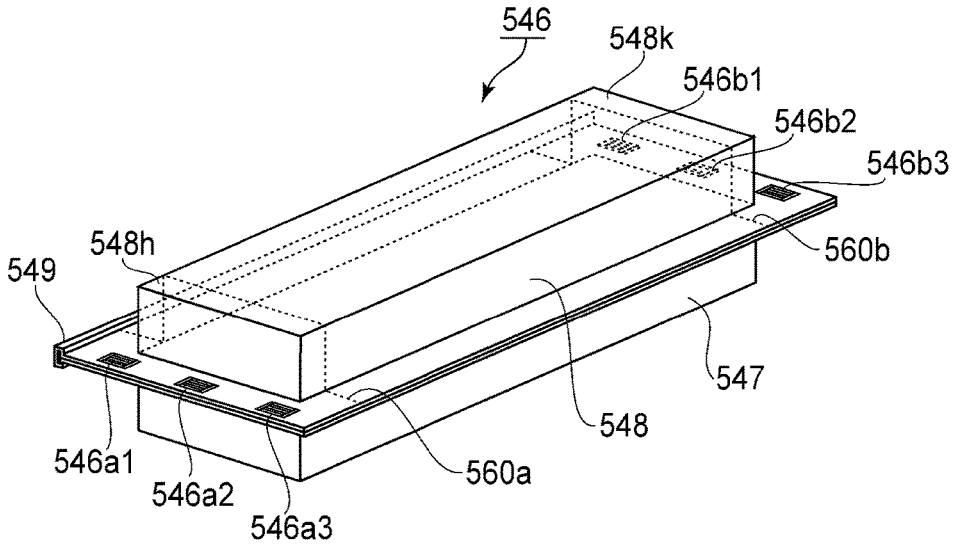

FIG. 26 is a schematic perspective view showing a packing member in Embodiment 6.

Figure 27:
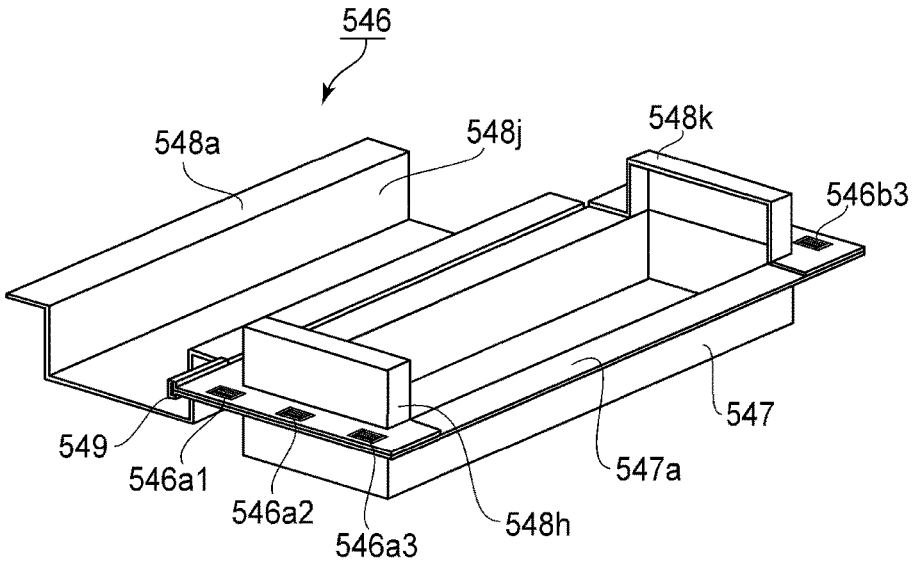

FIG. 27 is a schematic perspective view showing an unpacked state of the packing member in Embodiment 6.

Figure 28:
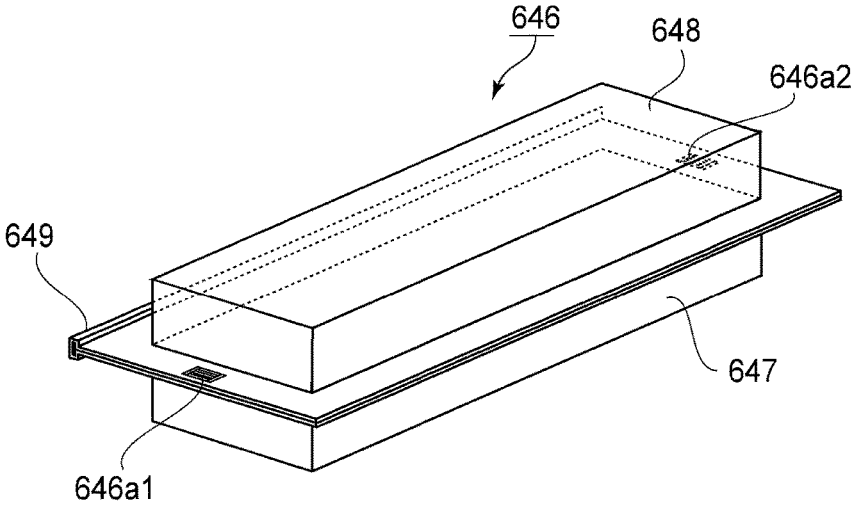

FIG. 28 is a schematic perspective view showing a packing member in a comparison example.

Figure 29:
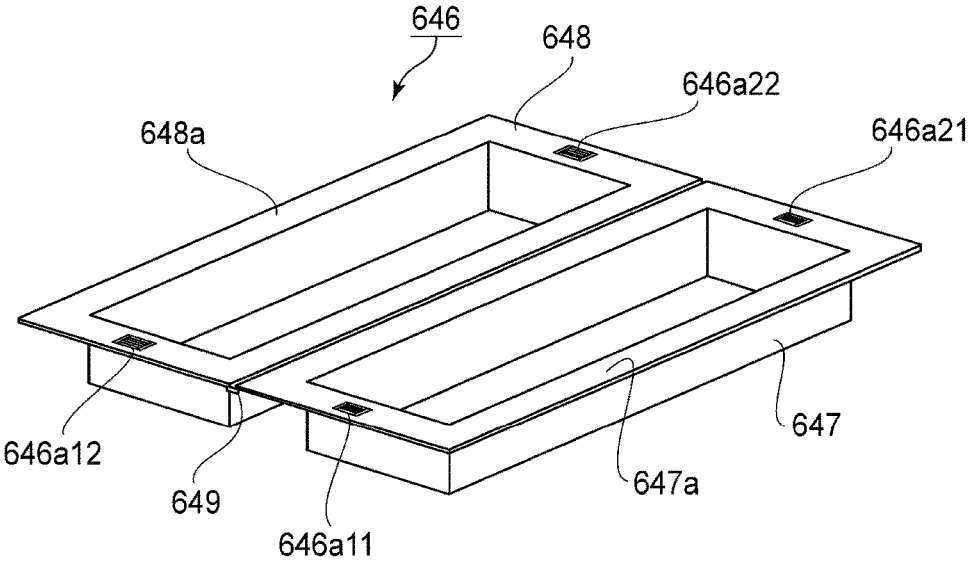

FIG. 29 is a schematic perspective view showing the packing member in the comparison example.

DESCRIPTION OF EMBODIMENTS

Embodiment 1

Embodiment 1 of the present invention will be described with reference to FIGS. 2 to 12.

Incidentally, in the following embodiments, as an electrophotographic image forming apparatus, a full-color electrophotographic image forming apparatus to which four cartridges are detachably mountable is described as an example.

However, the number of the cartridges to be mounted in the image forming apparatus is not limited to four but may appropriately be set as desired.

For example, in the case of an image forming apparatus for forming a monochromatic image, the number of the cartridges to be mounted in the image forming apparatus is one. Further, in the following embodiments, as an example of the image forming apparatus, a printer is exemplified.

However, the image forming apparatus is not limited to the printer. The present invention is also applicable to, e.g., other image forming apparatuses such as a copying machine, a facsimile machine and a multi-function machine having functions of these machines in combination.

<General Structure of Image Forming Apparatus>

Figure 2:
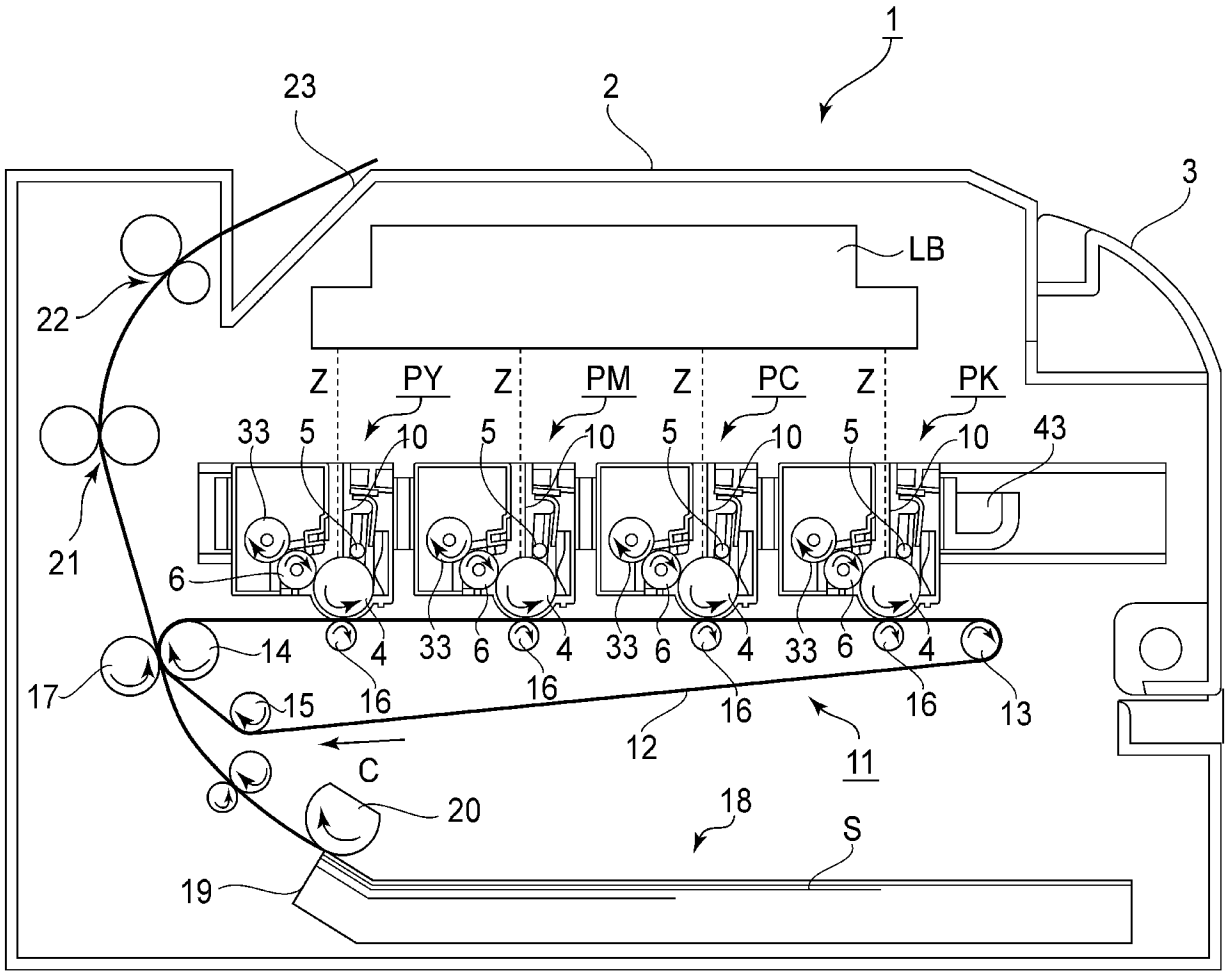
FIG. 2 is a schematic sectional view showing an image forming apparatus main assembly in Embodiment 1.

First, FIG. 2 is a schematic sectional view of the image forming apparatus in this embodiment.

As shown in FIG. 2, an image forming apparatus 1 is a four color-based full-color laser printer using the electrophotographic image forming process and effects color image formation on a recording material S. The image forming apparatus 1 is of a process cartridge type in which the process cartridge is detachably mountable to an apparatus main assembly 2 and a color image is formed on the recording material S.

Here, with respect to the image forming apparatus 1, the side (surface) on which an openable door 3 is provided is referred to as a front side (surface), and a side (surface) opposite to the front side (surface) is referred to as a rear side (surface). Further, a right side when the image forming apparatus 1 is viewed from the front surface is referred to as a driving side, and a left side is referred to as a non-driving side.

In the apparatus main assembly 2, four cartridges P consisting of a first cartridge PY, a second cartridge PM, a third cartridge PC and a fourth cartridge PK are provided and arranged in a horizontal direction. The respective first to fourth cartridges (PY to PK) have the same electrophotographic process mechanism but contain developers (toners) different in color from one another. To the first to fourth cartridges P (PY to PK), a rotational driving force is transmitted from a drive output portion (not shown) of the apparatus main assembly 2. Further, to the first to fourth cartridges P (PY to PK), bias voltages (charging bias, developing bias and the like) are supplied from the apparatus main assembly 2 (not shown).

Each of the first to fourth cartridges P (PY to PK) includes a first frame including an electrophotographic photosensitive member (hereinafter referred to as a photosensitive drum) 4, and including a charging means and a cleaning means which are used as process means acting on the photosensitive drum 4. The first frame is referred to as a cleaning unit 8.

Further, each of the first to fourth cartridges P (PY to PK) includes a developing device 9 which is a second frame including a developing means for developing an electrostatic latent image on the photosensitive drum 4.

The cleaning unit 8 and the developing device 9 are connected with each other. As the charging means, a charging roller 5 is used. As the cleaning means, a cleaning blade 7 is used. As the developing means, a developer carrying member (hereinafter referred to as a developing roller) 6 is used. A more specific constitution of the cartridges will be described below.

The first process cartridge PY accommodates the toner of yellow (Y) in its developing (device) frame 29 and forms the toner image of yellow on the surface of the photosensitive drum 4. The second process cartridge PM accommodates the toner of magenta (M) in its developing frame 29 and forms the image of magenta on the surface of the photosensitive drum 4. The process third cartridge PC accommodates the toner of cyan (C) in its developing frame 29 and forms the toner image of cyan on the surface of the photosensitive drum 4. The fourth process cartridge PK accommodates the toner of black (K) in its developing frame 29 and forms the toner image of black on the surface of the photosensitive drum 4.

As shown in FIG. 2, above the first to fourth process cartridges P (PY, PM, PC, PK), a laser scanner unit LB as an exposure means is provided. This laser scanner unit LB outputs laser light Z correspondingly to image information. Then, the laser light Z passes through an exposure window portion 10 of each cartridge P, so that the surface of the photosensitive drum 4 is subjected to scanning exposure to the laser light Z.

Under the first to fourth cartridges P (PY, PM, PC, PK), an intermediary transfer belt unit 11 as a transfer member is provided. This intermediary transfer belt unit 11 includes a driving roller 13, a turn roller 14 and a tension roller 15, and includes a transfer belt 12 extended and stretched by the rollers. The photosensitive drum 4 of each of the first to fourth process cartridges P (PY to PK) is contacted to an upper surface of the transfer belt 12 at its lower surface. A resultant contact portion is a primary transfer portion. Inside the transfer belt 12, primary transfer rollers 16 are provided opposed to the associated photosensitive drums 4. Oppositely to the turn roller 14, a secondary transfer roller 17 is provided in contact with the transfer belt 12. A resultant contact portion between the transfer belt 12 and the secondary transfer roller 17 is a secondary transfer portion.

Below the intermediary transfer belt unit 11, a sheet feeding unit 18 is provided. This sheet feeding unit 18 includes a sheet feeding tray 19 in which sheets of the recording material S are stacked, and includes a sheet feeding roller 20 and the like.

In an upper left side of the apparatus main assembly 2 in FIG. 2, a fixing unit 21 and a sheet discharging unit 22 are provided. At an upper surface of the apparatus main assembly 2, a sheet discharge tray 23 is defined.

On the recording material S, the toner image is fixed by the fixing means provided in the fixing unit 21, and then the recording material S is discharged onto the discharge tray 23.

<Image Forming Operation>

Next, an operation for forming a full-color image is as follows. The photosensitive drums 4 of the first to fourth cartridges P (PY to PK) are rotationally driven at a predetermined speed (in an arrow D direction in FIG. 3 and in a counterclockwise direction in FIG. 2). The transfer belt 12 is also rotationally driven in the same direction (arrow C direction in FIG. 2) as the rotational direction of the photosensitive drums 4 (at their contact portions) at a speed corresponding to the speed of the photosensitive drums 4.

The laser scanner unit LB is also driven. In synchronism with the drive of the laser scanner unit LB, the surface of the photosensitive drum 4 of each cartridge P is electrically charged to a predetermined polarity and a predetermined potential by the charging roller 5. The scanner unit LB scans and exposes the surface of each photosensitive drum 4 with the laser light Z depending on an associated signal. As a result, the electrostatic latent image depending on the image signal for the associated color is formed on the surface of each photosensitive drum 4. The thus formed electrostatic latent image is developed by the developing roller 6 which is rotationally driven (in an arrow E direction in FIG. 3 or in the clockwise direction in FIG. 2) at a predetermined speed.

By the electrophotographic image forming process operation as described above, on the photosensitive drum 4 of the first cartridge PY, a yellow toner image corresponding to a yellow component for the full-color image is formed. Then, the toner image is primary-transferred onto the transfer belt 12.

Similarly, on the photosensitive drum 4 of the second cartridge PM, a magenta toner image corresponding to a magenta component for the full-color image is formed. Then, the toner image is primary-transferred superposedly onto the yellow toner image which has already been transferred on the transfer belt 12.

Similarly, on the photosensitive drum 4 of the third cartridge PC, a cyan toner image corresponding to a cyan component for the full-color image is formed. Then, the toner image is primary-transferred superposedly onto the yellow and magenta toner images which have already been transferred on the transfer belt 12.

Similarly, on the photosensitive drum 4 of the fourth cartridge PK, a black toner image corresponding to a black component for the full-color image is formed. Then, the toner image is primary-transferred superposedly onto the yellow, magenta and cyan toner images which have already been transferred on the transfer belt 12.

In this way, unfixed toner images of yellow, magenta, cyan and black for the four color-based full-color image are formed on the transfer belt 12.

On the other hand, at predetermined control timing, sheets of the recording material S are separated and fed one by one. The recording material S is introduced into a secondary transfer portion which is a contact portion between the secondary transfer roller 17 and the transfer belt 12 with predetermined control timing. As a result, in a process in which the recording material S is conveyed to the secondary transfer portion, the four color toner images superposed on the transfer belt 12 are collectively transferred onto the surface of the recording material S.

<Structure of Cartridge>

Parts (a) and (b) of FIG. 4 are schematic perspective views of each cartridge P (PY, PM, PC, PK) as seen from different angles (directions). In the following description, the respective cartridges P (PY to PK) have the same constitution, and therefore are collectively described as the cartridge P.

The cartridge P has a substantially rectangular parallelopiped shape extending in a direction of a rotational axis a of the photosensitive drum 4 as a longitudinal direction (arrow X direction), and includes the cleaning unit f, the developing device 9, a driving-side cover member 24 and a non-driving-side cover member 25.

Part (a) of FIG. 4 is the schematic perspective view of the cartridge P as seen from the driving side, and (b) of FIG. 4 is the schematic perspective view as seen from the non-driving side. The cartridge P has a two-frame structure in which the driving-side cover member 24 and the non-driving-side cover member 25 which are fixed on the cleaning unit 8 support rotatably the developing device 9 about a swing center (axis a indicated by a chain line in (a) of FIG. 4) of the developing device 9. Incidentally, the developing device 9 is urged in a certain direction (arrow W1 direction in FIG. 3) by a spring (not shown) or the like although specifically described later.

Figure 3:
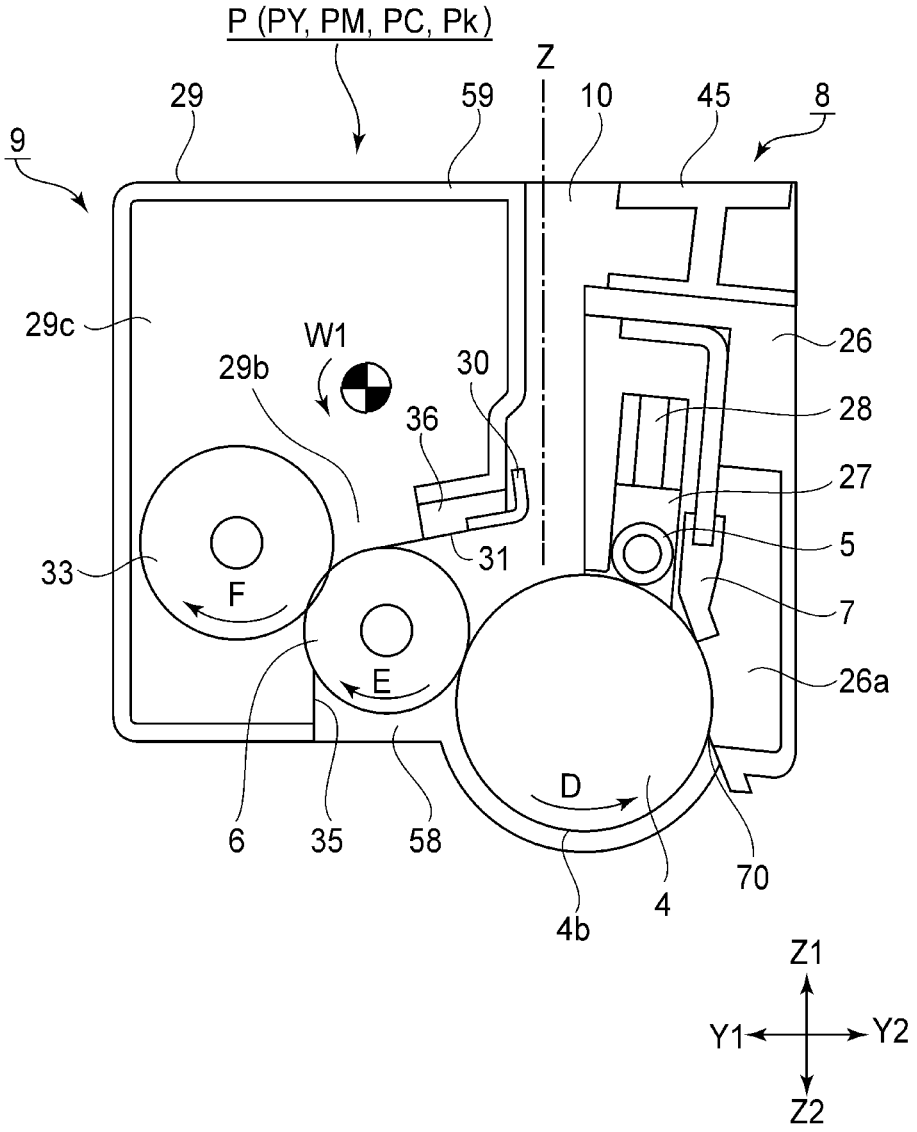
FIG. 3 is a schematic sectional view showing the cartridge in Embodiment 1.

As shown in FIG. 3, the cleaning unit (drum unit) 8 is constituted by the photosensitive drum 4, the charging roller 5, a cleaning container 26 including the cleaning blade 7, and a grip portion 45. As shown in (a) and (b) of FIG. 4, the photosensitive drum 4 is rotatably supported by the driving-side cover member 24 and the non-driving-side cover member 25, and obtains a driving force of a motor (not shown) of the apparatus main assembly 2 from drum driving coupling 4*a*, and thus is rotationally driven (in the arrow D direction in FIG. 3).

As shown in FIG. 3, the charging roller 5 is rotatably supported at its end portions by charging roller bearings 27 of the cleaning container 26 and is driven by rotation of the photosensitive drum 4 in contact with the surface of the photosensitive drum 4. At this time, in order to uniformly charge the surface of the photosensitive drum 4, the charging roller 5 is urged against the photosensitive drum 4 by a charging roller urging spring 28 at each of the end portions thereof. The cleaning blade 7 is fixed on the cleaning container 26, and an elastic rubber end portion thereof is disposed in contact with the photosensitive drum 4 in a direction counterdirectionally to the rotational direction (the arrow D direction in FIG. 3). During image formation, the cleaning blade 7 scrapes off a transfer residual toner remaining on the photosensitive drum 4 to clean the surface of the photosensitive drum 4. At this time, the end of the cleaning blade 7 is contacted to the surface of the photosensitive drum 4 at predetermined pressure in order to scrape off the transfer residual toner completely.

Further, the transfer residual toner scraped off from the surface of the photosensitive drum 4 by the cleaning blade 7 is accommodated as a waste (residual) toner in a residual toner accommodating portion 26*a* of the cleaning container 26. For that purpose, on the cleaning container 26, a residual toner collecting sheet member 70 for preventing the residual toner from leaking out from a gap between itself and the photosensitive drum 4 or the cleaning blade 7 is fixed with respect to the longitudinal direction of the photosensitive drum 4. Further, at each of longitudinal end portions of the cleaning blade 7, a cleaning blade end portion seal member (not shown) is provided.

The grip portion 45 is a portion where a user grips the cartridge P, and is mounted integrally with or as a separate part from the cleaning container 26. However, depending on the constitution of the image forming apparatus 1, in some cases, a mounting and demounting attitude, described later, of the cartridge P relative to the apparatus main assembly 2 is different from that in this embodiment. In that case, the grip portion 45 may also be provided on the developing frame 29.

In this embodiment, the cartridge P is the substantially rectangular parallelopiped. Of six sides, a side 58 includes an exposed portion 4*b* for permitting transfer of the toner image from the photosensitive drum 4 onto the intermediary transfer belt unit 11 described above. A side 59 opposite from the side 58 includes the above-described grip portion 45.

Further, as shown in (a) and (b) of FIG. 4, the cartridge P includes the following portions as portions where its positions in a packing member 46 are limited when the cartridge P is packed in the packing member 46 described later. That is, first portions-to-be-limited 24*b*, 25*b*, 24*g* and 25*g* are positionally limited relative to the packing member 46 with respect to a vertically downward direction (Z2 direction) and horizontal direction (Y1 and Y2 directions). Further, movement of a second portion-to-be-limited 26*c* is limited relative to the packing member 46 with respect to a vertically upward direction (Z1 direction). Further movement of third portion-to-be-limited 24*f* and 25*f* is limited with respect to a longitudinal direction of the cartridge P (i.e., an axial direction of the photosensitive drum 4, X1 and X2 directions). Incidentally, with respect to the positional limitation of the cartridge P in the packing member 46 by using the above-described respective portion-to-be-limited will be specifically described later.

<Mounting and Demounting Constitution of Cartridge>

Next, a mounting and demounting operation of the cartridge P with respect to the apparatus main assembly 2 will be described.

FIG. 5 is a schematic sectional view showing a state in which a cartridge tray 43 is pulled out from the apparatus main assembly 2 and thus the cartridge P is detachably mountable to the cartridge tray 43. FIG. 6 is a schematic sectional view for illustrating an operation by which the cartridge P is demounted from and mounted into the cartridge tray 43.

As shown in FIG. 5, inside the apparatus main assembly 2, the cartridge tray 43 in which the cartridges P are mountable is provided. The cartridge tray 43 is constituted so as to be linearly movable (pullable and pushable) in G1 and G2 directions which are substantially the horizontal direction with respect to the apparatus main assembly 2. Further, the cartridge tray 43 is capable of being in a mounted position, and in a pulled-out position where the cartridge tray 43 is pulled out from the mounted position.

First, the mounting operation for mounting the cartridge P into the apparatus main assembly 2 will be described. The openable door 3 is opened, and then the cartridge tray 43 is moved in G1 direction indicated by an arrow in FIG. 5 to be moved to the pulled-out position. In this state, the cartridge P is mounted in the cartridge tray 43 from an arrow H1 direction to be held. The cartridge tray 43 holding the cartridge P is moved in an arrow G2 direction shown in FIG. 6, so that the cartridge tray 43 is moved to the mounted position. Then, the openable door 3 is closed, so that the mounting operation of the cartridge P into the apparatus main assembly 2 is completed.

Then, the demounting operation of the cartridge P from the apparatus main assembly 2 will be described. Similarly as in the mounting operation of the cartridge P into the apparatus main assembly 2 described above, the cartridge tray 43 is moved to the pulled-out position. In this state, the cartridge P is demounted in an arrow H2 direction shown in FIG. 6, so that the demounting operation of the cartridge P from the apparatus main assembly 2 is completed. By the above-described operations, the cartridge P is detachably mountable to the apparatus main assembly 2. Incidentally, a mounting process of the cartridge P from the packing member 46 into the apparatus main assembly 2 will be described later specifically.

<Structure of Developing Device>

As shown in FIGS. 3 and 7, the developing device 9 has an elongated shape in which the developing roller 6 as the developing means extends in a rotational axis direction as the longitudinal direction. In addition to the developing roller 6, the developing device 9 is constituted by the developing frame 29, a developing blade 31, developing device end portion seal members 34R and 34L, a flexible sheet member 35, and supplying roller shaft seals 37R and 37L (FIG. 7). Further, as shown in FIG. 3, the developing frame 29 includes a toner accommodating chamber 29*c* for accommodating the toner and includes an opening 29*b* for permitting discharge of the toner from the toner accommodating chamber 29*c*. The developing roller 6 and the developer supplying roller 33 are provided close to the opening 29*b*. Further, as shown in FIG. 7, end portions of a shaft (core material 6*a*) of the developing roller 6 are rotatably supported by a driving-side bearing 38 and a non-driving-side bearing 39 which are mounted on side surfaces of the developing frame 29. Further, at driving-side end portions of the core material 6*a* of the developing roller 6 and a core material 33*a* of the developer supplying roller 33, a developing roller gear 40 and a supplying roller gear 41 are provided, respectively, and are engaged with a developing device drive input gear 42. The developing device drive input gear 42 includes a developing device drive coupling 42*a* with which a drive output coupling (not shown) in the apparatus main assembly 2 side, so that a driving force of a driving motor (not shown) for the apparatus main assembly 2 is transmitted and thus the developing roller 6 and the developer supplying roller 33 are rotationally driven at a predetermined speed. The developing blade 31 is an about 0.1 mm-thick elastic metal plate, and a free end of the developing blade 31 with respect to a widthwise direction is contacted to the developing roller 6 counterdirectionally to the rotational direction (arrow E direction in FIG. 3).

As shown in FIG. 7, the developing device end portion seal members 34R and 34L are provided at ends of the opening of the developing frame 29, so that toner leakage from a gap between the developing frame 29 as a second frame and each of the developing blade 31 and the developing roller 6 is prevented. Further, the flexible sheet member 35 is provided in contact with the developing roller 6 along the longitudinal direction in a side where the sheet member 35 opposes the developing blade 31 at the opening of the developing frame 29, thus preventing the toner leakage from a gap between the developing frame 29 and the developing roller 6. Further, the supplying roller shaft seal members 37R and 37L are mounted on the core material 33*a* of the developer supplying roller 33 at exposed portions outside the developing frame 29, thus preventing the toner leakage from a gap between the core material 33*a* and a core material through hole 29*d* provided in the developing frame 29.

The developing device (developing unit) 9 is always urged by an urging spring (not shown) in a direction (arrow W1 direction in FIG. 3), in which the developing roller 6 is contacted to the photosensitive drum 4, with the swing center (axis a) shown in FIG. 4 as a center. During the image formation, by the drive, the developer supplying roller 33 and the developing roller 6 are rotated and rubbed with each other, so that the toner in the developer frame 29 is carried on the developing roller 6. The developing blade 31 regulates a thickness of a toner layer formed on a peripheral surface of the developing roller 6, and at the same time, imparts triboelectric charges, generated between itself and the developing roller 6 by contact pressure, to the toner. Then, at the contact portion between the developing roller 6 and the photosensitive drum 4, the charged toner on the developing roller 6 is deposited on the electrostatic latent image, so that the electrostatic latent image is developed.

Further, during non-image formation, the developing roller 6 is spaced from the photosensitive drum 4, thus preventing deformation thereof at its surface. That is, the developing device 9 is constituted so as to be movable relative to the cleaning unit 8 and thus is capable of moving the developing roller 6 toward and away from the photosensitive drum 4.

<Structure of Packing Member>

A structure of the packing member 46 will be described with reference to FIGS. 1, 8, 9 and 10.

Figure 1:
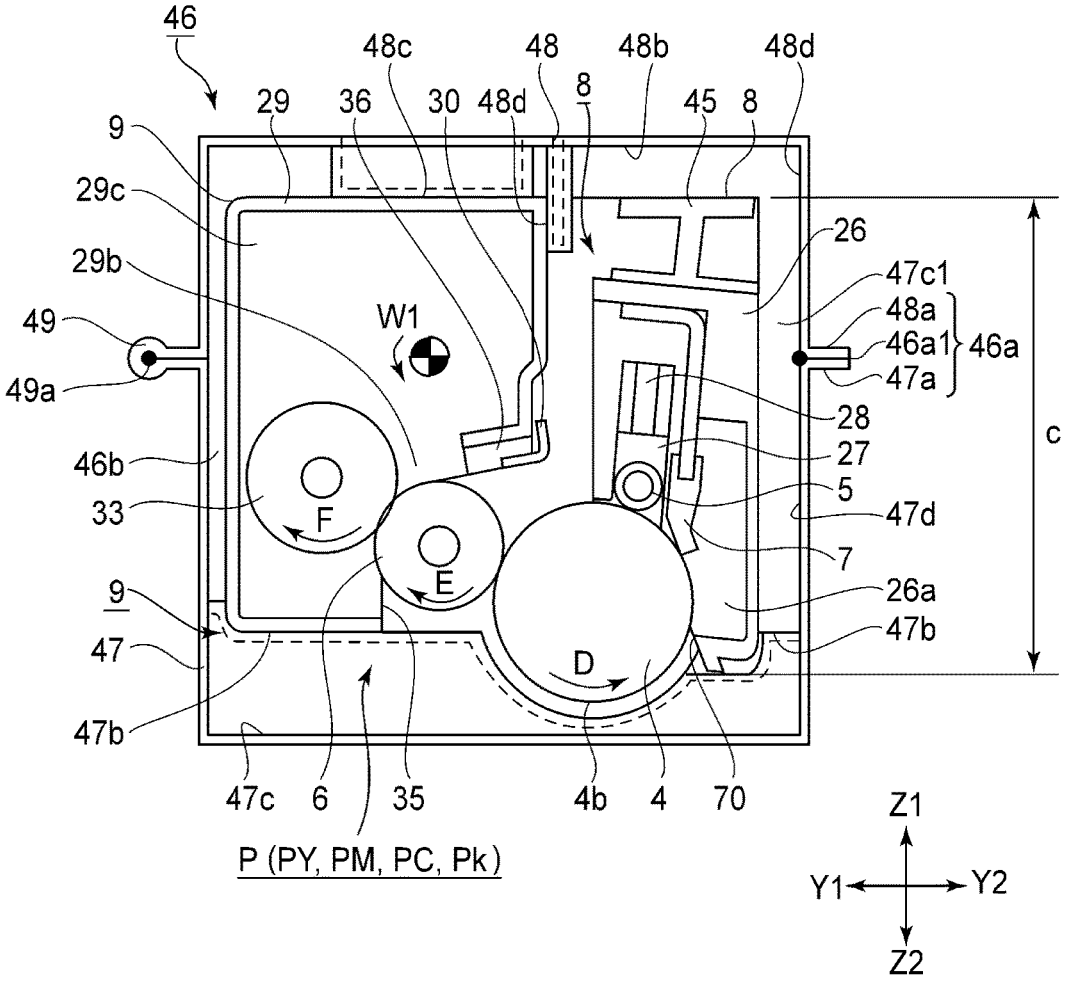
FIG. 1 is a schematic sectional view showing a packing state of a cartridge in a packing member in Embodiment 1.

FIG. 1 is a schematic sectional view showing a packing state of the cartridge P in the packing member 46 in this embodiment. Parts (a) and (b) of FIG. 8 are schematic perspective views, as seen from different angles, each showing the packing member 46 in this embodiment. Parts (a) and (b) of FIG. 9 are schematic perspective views, as seen from different angles, each showing a demountable state of the cartridge P from the packing member 46 in this embodiment. Here, a longitudinal direction of the packing member 46 is the same as the longitudinal direction (X1 and X2 directions) of the cartridge P when the cartridge P is accommodated in the packing member 46. FIG. 10 is a schematic perspective view showing the cartridge-packed state of the packing member 46 in this embodiment.

As shown in (a) and (b) of FIG. 8, the packing member 46 is constituted by a frame portion 47, a cap portion 48 and a hinge portion 49. The frame portion 47 and the cap portion 48 are rotatable, relative to each other, after a rotation shaft 49*a* of the hinge portion 49 (FIG. 1). Each of the frame portion 47, the cap portion 48 are the hinge portion 49 which constitute the packing member 46 is constituted by a thin plate (sheet) of plastic (resin material), such as polyethylene terephthalate or polypropylene. As a molding method, the resin material can be molded by vacuum molding, air-pressure molding, vacuum air-pressure molding, drawing (molding), or injection molding. In the vacuum molding, a heated resin sheet is molded in a predetermined shape by air suction on a mold. In the air-pressure molding, the heated resin sheet is molded in the predetermined shape by being closely contacted to the mold under application of a force of compressed air. In the vacuum air-pressure molding, the heated resin sheet is molded in the predetermined shape by using the vacuum molding and the air-pressure molding in combination. In the drawing (molding), the heated resin sheet is molded in the predetermined shape by being fixed on a male mold and then by pushing a female mold against the male mold to compress the resin sheet. In the injection molding, a melted resin material is injected into a space formed by the male mold and the female mold to be molded in the predetermined shape. The vacuum molding and the air-pressure molding are, compared with the drawing (molding) and the injection molding, capable of molding the resin material into a molded part (product) at a low cost, but are liable to be inferior in dimensional accuracy of the molded product. In this case, however, by employing the vacuum air-pressure molding, the dimensional accuracy can be improved compared with the case where each of the vacuum molding and the air-pressure molding is employed alone. However, the resin material can be molded inexpensive by employing the vacuum molding.

As shown in FIG. 8, the frame portion 47 includes a first recessed portion 47*c* having a recessed shape provided with a first opening 47*c*1. Further, the cap portion 48 includes a second recessed portion 48*b* having a recessed shape provided with a second opening 48*b*1. Further, at the frame portion 47 and the cap portion 48, flange portions 47*a* and 48*a* are formed so as to surround the first recessed portion 47*c* and the second recessed portion 48*b*, respectively. The frame portion 47 and the cap portion 48 are connected at the hinge portion 49, thus being integrally molded. Further, the cap portion 48 is capable of being located in a closed position where the cap portion 48 is capable of covering the first opening 47*c*1 of the frame portion 47 (FIGS. 1 and 11) and an open position where the first opening 47*c*1 is open (FIG. 12).

The mounting of the cartridge P in the packing member 46 will be described. The cartridge P is, as shown in (a) and (b) of FIG. 9, supported in a first state at the frame portion 47 of the packing member 46. This will be specifically described later. Here, in the first state, as shown in (a) and (b) of FIG. 9, the cartridge P inserted into the packing member 46 in an arrow Z2 direction through the first opening 47*c*1 is detachably mounted in the packing member 46. Further, in the first state, the cartridge P is held by the frame portion 47 and the frame portion 47 covers the exposed portion 4*b* ((b) of FIG. 4) of the photosensitive drum 4 of the cartridge P. Further, in the first state, the exposed portion 4*b* of the photosensitive drum 4 is prevented from contacting an inner surface of the frame portion 47 and a user is capable of gripping the grip portion 45 of the cartridge P. Further, from the state shown in (a) and (b) of FIG. 9, the cap portion 48 is rotated, about the rotation shaft 49*a* of the hinge portion 49, toward the frame portion 47, so that the flange portion 48*a* of the cap portion 48 is contacted to the flange portion 47*a* of the frame portion 47 as shown in FIG. 10. Thereafter, the flange portion 47*a* of the frame portion 47 and the flange portion 48*a* of the cap portion 48 are partly or wholly bonded to each other. As a result, as shown in FIG. 1, the first recessed portion 47*c* of the frame portion 47 and the second recessed portion 48*b* of the cap portion 48 form a connecting portion 46*a* (FIGS. 1 and 10) in combination. Thus, an accommodating space 46*b* is created inside the packing member 46, so that the packing member 46 is in a second state (packing state) in which the cartridge P is capable of being accommodated in the accommodating space 46*b* (FIG. 10). In this second state, the second recessed portion 48*b* of the cap portion 48 covers the entire cartridge P or a part of the cartridge P so as to accommodate the grip portion 45 of the cartridge P which is the substantially rectangular parallelopiped. Incidentally, the connecting portion 46*a* includes an unpacking portion 46*a*1 at an opposing position from the hinge portion 49. Although details will be described later, the user unseals (unpacks) the packing member 46 from the unpacking portion 46*a*1 of the connecting portion 46*a*. Further, it is also possible to employ a constitution in which the frame portion 47 and the cap portion 48 are not bonded at the unpacking portion 46*a*1. By the above-described packing, the whole cartridge P is covered with the frame portion 47 and the cap portion 48 to be placed in the packed state (FIGS. 1 and 10). Incidentally, in FIG. 1, the connecting portion 46*a* where the flange portion 47*a* of the frame portion 47 and the flange portion 48*a* of the cap portion 48 are connected with each other to accommodate the cartridge P is formed at a position which is roughly ½ of a height c of the cartridge P as seen from the longitudinal direction but is not limited thereto. For example, the connecting portion may also be provided above the upper point of the height c of the cartridge P. Further, the cartridge P is the substantially rectangular parallelopiped, and the packing member 46 includes the frame portion 47 and the cap portion 48 which are similar figures. However, the cartridge P may have any shape, and if the whole cartridge P or a part, of the cartridge P, to be protected, is covered with the packing member 46, also the packing member may have any shape. Further, as a bonding means between the flange portion 47*a* of the frame portion 47 and the flange portion 48*a* of the cap portion 48, it is possible to use (thermal) welding adhesive bonding, bonding with a double-side tape, hooking, or the like. However, the bonding means may only be required that the flange portions 47*a* and 48*a* can be bonded to each other, and is not limited to the above means. That is, it is also possible to employ a constitution in which the frame portion 47 and the cap portion 48 are separate members and the flange portions 47*a* and 48*a* are bonded to each other.

Next, in the packed state, positional limitation of the cartridge P by the packing member 46 will be described. In order to effect the positional limitation of the cartridge P with respect to the X1 and X2 direction, a pair of third limiting portions 47*f* formed as shown in (a) and (b) of FIG. 8 at inner surfaces, of the frame portion 47, corresponding to longitudinal ends of the cartridge P is contacted to third portions-to-be-limited 24*f* and 25*f* of the cartridge P shown in (a) and (b) of FIG. 9. Accordingly, the positions of the cartridge P with respect to the X1 and X2 directions are limited in the first state described above. Further, in order to effect the positional limitation of the cartridge P with respect to Y1 and Y2 directions and Z2 direction shown in (a) and (b) of FIG. 4, the packing member 46 includes first positions 47*g* and 47*b* formed at an upper surface of the frame portion 47 shown in (a) and (b) of FIG. 8. Here, in the Z2 direction, the cartridge P enters the frame portion 47. Further, the Y1 and Y2 directions are a direction which crosses (is perpendicular to) the longitudinal direction of the cartridge P and which crosses (is perpendicular to) Z2 direction in which the cartridge P enters the frame portion 47.

Then, the first limiting portions 47*g* and 47*b* are contacted to first portions to be limited 24*g*, 25*g*, 24*b* and 24*a* shown in (a) and (b) of FIG. 9. Accordingly, the positions of the cartridge P with respect to the Y (Y1 and Y2) directions is limited in the first state described above. Further, as shown in (a) and (b) of FIG. 8, second limiting portions 48*c* are formed in the cap portion 48. Further, the second limiting portions 48*c* is, as shown in (a) and (b) of FIG. 9, formed at positions corresponding to second portions to be limited 26*c* of the cartridge P in the packing state (second state) of the packing member 46. Further, with respect to the cartridge P, in the packing state (second state) the second portions to be limited 26*c* contact the second limiting portions 48*c* of the cap portion 48. As a result, movement of the cartridge P in Z1 direction in which the cartridge P is spaced from the first limiting portions 47*b* is limited, so that the positional limitation of the cartridge is made. That is, in the first state shown in (a) and (b) of FIG. 9, the cartridge P is not limited with respect to the Z1 direction opposite to the direction of gravitation. In the above described packing state (second state), the packing member 46 does not contact the cartridge P at portions other than the limiting portions 47*f*, 47*b*, 48*c* and 47*g* shown in FIG. 8. For that reason, the packing member 46 generates elastic deformation and plastic deformation at the portions other than the respective limiting portions when vibration and impact are generated during transportation, so that the packing member 46 is capable of absorbing the vibration and the impact during transportation.

Therefore, the packing member 46 does not directly transmit the vibration and the impact during transportation to the photosensitive drum 4 and the process means and thus functions as a protecting member for protecting the cartridge P. Accordingly, it becomes also possible to eliminate a drum shutter, for protecting the photosensitive drum 4, from the cartridge P. Further, each of the limiting portions of the packing member 46 may be contacted to the cartridge P at any position if the position is not in a region where the electrostatic latent image is to be formed on the photosensitive drum 4 of the cartridge P. For example, even when the limiting portions are contacted to the developing frame 29, a similar effect can be obtained. However, when the third portions to be limited 24*b* and 25*b* have high rigidity, the cartridge P is less broken by the impact or the like during transportation. Further, in the first state, the cartridge P has already by positionally limited by the frame portion 47 of the packing member 46 with respect to the X1, X2, Y1, Y2 and Z1 directions. That is, in order to fix the cartridge P in the packing member 46, when the state of the packing member 46 is changed from the first state to the second state, the cartridge P is only required to be covered with the cap portion 48, so that an assembling property can be further improved. Further, the limiting portions 47*f*, 47*b*, 48*c* and 47*g* are formed in the packing member 46 but may also be constituted as separate members.

As described above, as shown in (a) of FIG. 4, the developing device 9 is rotatably supported by the driving-side cover member 24 and the non-driving-side cover member 25 which are fixed on the cleaning unit 8 as described above. For that reason, as shown in (b) of FIG. 11, there is a possibility that the developing device 9 is rotationally moved in the clockwise direction (arrow W2 direction) against an urging force by the vibration and the impact generated during transportation of the cartridge P. At this time, the developing device 9 causes rotational motion by which the developing device 9 is restored to an attitude in which the developing device 9 is urged by the urging force, so that there is a possibility that the developing device 9 collides with the cleaning unit 8 and then friction memory between the photosensitive drum 4 and the developing roller 6 appears as an image defect. Further, in the above, the case where the developing device 9 includes the urging means such as the spring or the like has been described, but also in a constitution in which the developing device 9 does not include the urging means, during transportation of the cartridge P, there is a possibility that similar collision occurs. Here, a fixing method in which the developing device 9 in the member 46 during transportation of the cartridge P is not readily moved relative to the cleaning unit 8 will be described. Parts (a) and (b) of FIG. 11 are schematic sectional views each showing the packing state in which the cartridge P is packed in the packing member 46. Part (a) of FIG. 11 shows a state in which the developing device 9 is urged toward the cleaning frame (unit) 9 by a spring (not shown) or the like in the counterclockwise direction (arrow w1 direction) and in which the developing roller 6 contacts the photosensitive drum 4. On the other hand, (b) of FIG. 11 shows a state in which the developing device 9 is rotationally moved relative to the cleaning frame 9 in the clockwise direction (arrow w1 direction) against the urging force.

The developing device 9 includes a fourth portion-to-be-limited 29*d*. Further, the cap portion 48 of the packing member 46 includes a fourth limiting portion 48*d* formed therein. That is as shown in (a) of FIG. 11, with respect to the counterclockwise direction (arrow w1 direction) with the rotation axis a ((a) of FIG. 4) as the center, the fourth limiting portion 48*d* is provided downstream of the fourth portion-to-be-limited. Therefore, when the cartridge P is packed in the packing member 46, the fourth portion-to-be-limited 29*d* of the developing device 9 is supported by the fourth limiting portion 48*d*, so that excessive rotational movement of the developing device 9 in the clockwise direction (arrow w2 direction in (b) of FIG. 11) can be suppressed. As described above, by providing the fourth portion-to-be-limited 29*d* as a part of the developing device 9 and by forming the fourth limiting portion 48*d* as a part of the cap portion 48 of the packing member 46, it is possible to suppress the excessive rotational movement of the developing device 9 in the clockwise direction (arrow w2 direction in (b) of FIG. 11). As a result, a degree of the collision between the developing device 9 and the cleaning unit 8 due to the vibration and the impact generated during transportation of the cartridge P can be reduced. As a result, e.g., it is possible to reduce a degree of memory on the photosensitive drum 4 due to friction (sliding) between the developing roller 6 and the photosensitive drum 4.

<Relationship Between Grip Portion and Packing Member>

A positional relationship between the grip portion 45 of the cartridge P and the packing member 46 will be described with reference to FIG. 11. The cartridge P includes the grip portion 45 provided as a part of the cleaning unit 8, and is packed in an attitude in which the cleaning unit 8, the developing device 9 and the hinge portion 49 are arranged in this order in Y1 direction. However, as described above, the grip portion 45 is provided as a part of the developing device in some cases. In the case, the cartridge P is packed in an attitude in which the hinge portion 49, the cleaning unit 8 and the developing device 9 are arranged in Y1 direction.

A demounting operation of the cartridge P from the packing member 46 will be described with reference to FIGS. 10 and 12. FIG. 12 is a schematic sectional view showing a state in which the cartridge P is demountable (detachable) from the packing member 46. The demounting operation of the cartridge P is performed in the order of uncovering of the cap portion 48, grip of the grip portion 45, demounting of the cartridge P and mounting of the cartridge P into the apparatus main assembly 2.

In FIG. 10, the user separates the connecting portion 46*a* of the cap portion 48, connected openably with the frame portion 47, from an unpacking portion 46*a*1 by an unshown means. That is, from the connecting portion 46*a* where the flange portion 47*a* is located, the flange portion 48*a* is separated. Then, the user rotationally moves the cap portion 48 about a rotation shaft 49*a* of the hinge portion 49 as an axis in an arrow R direction in FIG. 12. By about 180-degree rotational movement of the cap portion 48, the cartridge P is in a demountable state (FIG. 12), so that the uncovering operation of the cap portion 48 is completed. Incidentally, if the cartridge P is demountable, the cap portion 48 may also be not rotated by 180 degrees. Here, the user easily performs the uncovering operation of the packing member 46 in the case where the unpacking portion 46*a*1 is disposed in the front side rather than in the case where the hinge portion 49 is disposed in the front side. In the following, the uncovering by the user is performed in the state in which the unpacking portion 46*a*1 of the packing member 46 is disposed in the front side.

Then, the user grips the grip portion 45. The grip of the grip portion 45 by the user is made by gripping the grip portion 45 after the user rotationally moves the cap portion 48. At this time, as described above, the grip portion 45 is located in the unpacking portion 46*a*1 side. For that reason, the user easily recognizes the grip portion 45 when the cap portion 48 is uncovered and can smoothly perform the grip of the grip portion 45 with no obstruction to a gripping operation by the cap portion 48.

Next, a mounting operation of the cartridge P, after being demounted, into the apparatus main assembly 2 will be described. This operation is performed, after the user demount the cartridge P by moving the cartridge P in an arrow J direction shown in FIG. 12, by mounting the cartridge P into the apparatus main assembly 2. When the user mounts the cartridge P into the apparatus main assembly 2, the user is positioned in a downstream side of the apparatus main assembly 2 with respect to a pulling-out direction G1 of the cartridge tray 43 shown in FIG. 5. Further, an attitude of the cartridge P when the user mounts the cartridge P into the apparatus main assembly 2 is such that the cleaning unit 8 is located downstream of the developing device 8 with respect to the pulling-out direction G1. Further, in the attitude, with respect to the mounting direction H1 of the cartridge P shown in FIG. 6, the photosensitive drum 4 is located in the downstream side and the grip portion 45 is located in the upstream side. This attitude is the same as that of the cartridge P when the user grips the grip portion 45 of the cartridge P accommodated in the packing member 46. That is, the user can mount the cartridge P into the apparatus main assembly in the attitude, in which the user demount the cartridge P from the packing member 46, as it is. Therefore, the user is free from inconveniences, such that the cartridge P is shifted from one hand to the other and such that the wrist is twisted, during the mounting of the cartridge P, after being demounted, into the apparatus main assembly 2, thus leading to improvement in usability.

As described above, in this embodiment, when the vibration and the impact during transportation are generated, the packing member 46 permits generation of elastic deformation and plastic deformation at portions other than the respective limiting portions and thus is capable of absorbing the vibration and the impact during transportation. The packing member 46 functions as a cartridge packing member capable of protecting the cartridge P from the vibration and the impact during transportation. Further, the packing member 46 is formed by subjecting the thin resin material sheet to the vacuum molding or the like. Accordingly, compared with a conventional packing method in which a corrugated cardboard carton and a cushioning material such as styrene foam are used in combination, it is possible to pack the cartridge P with space saving.

Further, the cartridge P is constituted by the first frame 8 as the cleaning frame for rotatably supporting the photosensitive drum 4 and by the second frame 9 as the developing frame, supported by the first frame 8, for supporting the process means. Further, the packing member 46 includes the fourth limiting portion 48*d* for limiting movement of the second frame 9 in the accommodating space 46*b*. As a result, with respect to the cartridge P, rotation of the second frame 9 in the direction in which the process means are spaced from the photosensitive drum 4 is limited, so that the vibration and impact during transportation are suppressed.

Further, the cartridge P has the grip portion 45, to be gripped for demounting the cartridge P from the packing member, at a develop opposite from the photosensitive drum 4. At this time, in a cross section perpendicular to the axial direction of the photosensitive drum 4, the photosensitive drum 4 is disposed in the frame portion 47 side and the grip portion 45 is disposed in the cap portion 48 side. As a result, the user can take out the cartridge P from the packing member 46 without impairing the usability during unpacking of the cartridge P from the packing member 46.

Incidentally, in this embodiment, the constitution in which the cartridge P is formed in the substantially rectangular parallelopiped shape and the grip portion 45 is disposed at a surface opposite from the exposed portion of the photosensitive drum 4 is employed, but the present invention is not limited thereto. When the cartridge P is packed in the packing member 46, it is also possible to employ a constitution such that the exposed portion 4*b* is accommodated in the first recessed portion 47*c* of the frame portion 47 and the grip portion 45 is accommodated in the second recessed portion 48*b* of the cap portion 48. For example, the cartridge is formed in a substantially triangular prism shape and an exposed portion is provided in a side other than triangular sides. At this time, the grip portion is disposed in a side which is not opposite from the exposed portion side. Also in this case, when the cartridge is packed in the packing member, a constitution in which the exposed portion is accommodated in a recessed portion of the frame portion and the grip portion is accommodated in a recessed portion of the cap portion may only be required to be employed.

Embodiment 2

Embodiment 2 will be described with reference to FIGS. 13 to 15. In Embodiment 2, in place of the cartridges P each constituted by the cleaning unit 8 and the developing device 9 in Embodiment 1, cartridges Q (QY, QM, QC, QK) each constituted by only the developing device are used. For that reason, with respect to portions common to Embodiments 1 and 2, description of the portions will be omitted.

<General Structure of Image Forming Apparatus>

First, FIG. 14 is a schematic sectional view of an image forming apparatus 100 in this embodiment.

The image forming apparatus 1 is a four color-based full-color laser printer using the electrophotographic image forming process and effects color image formation on a recording material S. In the image forming apparatus 100, the cartridge Q is, as shown in FIG. 14, detachably mountable to an apparatus main assembly 102 and a color image is formed on the recording material S.

However, in this embodiment, a constitution in which the cartridge Q is detachably mountable to the apparatus main assembly 102 is employed but the present invention is not limited thereto. It is also possible to employ a constitution in which the cleaning unit 8 is detachably mountable to the apparatus main assembly 102. Incidentally, other parts, of the apparatus main assembly 102, having the same functions as those in Embodiment 1 are represented by the same reference numerals or symbols and will be omitted from description.

<Structure of Cartridge>

Parts (a) and (b) of FIG. 13 are schematic perspective views each showing the cartridge Q in this embodiment, in which (a) is the schematic perspective view of the cartridge Q as seen from the driving side, and (b) is the schematic perspective view of the cartridge Q as seen from the non-driving side. The cartridge Q includes a grip portion 145. The grip portion 145 is a portion to be gripped by the user, and is mounted on a developing (device) frame 129 integrally or as a separate member. Further, the cartridge Q is the substantially rectangular parallelopiped. Of six sides, a side 158 includes an exposed portion 6*b* for permitting development of the electrostatic latent image on the photosensitive drum 4 with the toner on the developing roller 6. A side 159 opposite from the side 158 includes the above-described grip portion 145. The position of the grip portion 145 will be described later.

The cartridge Q includes, as portion to be positionally limited in a packing member 146 when the cartridge Q is packed in the packing member 146 described later, third portions-to-be-limited 139*f* and 144*f*, first portions-to-be-limited 129*b*, 144*b*, 139*g* and 144*g*, and a second portion-to-be-limited 129*c*.

The third portions-to-be-limited 139*f* and 144*f* are used for positional limitation of the cartridge Q in the packing member 146 described later with respect to the longitudinal direction (X (X1, X2) direction in FIG. 10) which is the axial direction of the developing roller 6. The first portions-to-be-limited 139*b* and 144*b* and the second portion-to-be-limited 129*c* are used for positional limitation of the cartridge Q with respect to Y1 and Y2 directions perpendicular to (crossing) the X1 and X2 directions and with respect to Z1 direction as the vertically downward direction, respectively. The positional limitation of the cartridge Q in the packing member 146 by using the respective portions-to-be-limited will be specifically described later.

Other constitutions are the same as those of the developing device 9 described in Embodiment 1 and therefore will be omitted from description.

<Mounting and Demounting Constitution of Cartridge>

Next, a mounting and demounting operation of the cartridge Q with respect to the apparatus main assembly 102 will be described.

FIG. 14 is a schematic sectional view showing a state in which a cartridge tray 43 is pulled out from the apparatus main assembly 102 and thus the cartridge Q is detachably mountable to the cartridge tray 43, and is a schematic sectional view for illustrating an operation by which the cartridge Q is demounted from and mounted into the cartridge tray 43.

Inside the apparatus main assembly 102, the cartridge tray 43 in which the cartridges Q are mountable is provided. Further, in the cartridge tray 43, the cleaning unit 8 is mounted in advance. The cartridge tray 43 is, as shown in FIG. 14, constituted so as to be linearly movable (pullable and pushable) in G1 and G2 directions which are substantially the horizontal direction with respect to the apparatus main assembly 102. Further, the cartridge tray 43 is capable of being in a mounted position in the apparatus main assembly 102 and in a pulled-out position where the cartridge tray 43 is pulled out from the mounted position.

First, the mounting operation for mounting the cartridge Q into the apparatus main assembly 102 will be described. The openable door 3 is opened, and then the cartridge tray 43 is moved in G1 direction indicated by an arrow in FIG. 14 to be moved to the pulled-out position. In this state, the cartridge Q is mounted in the cartridge tray 43 from an arrow H1 direction in FIG. 14, so that an exposed portion 6*b* (FIG. 13) of the developing roller 6 is positioned at an opposing portion to the photosensitive drum 4. Then, the cartridge tray 43 is moved in an arrow G2 direction shown in FIG. 14, so that the cartridge tray 43 is moved to the mounted position in the apparatus main assembly 102. Then, the openable door 3 is closed, so that the mounting operation of the cartridge Q into the apparatus main assembly 102 is completed.

On the other hand, the demounting operation of the cartridge Q from the apparatus main assembly 102 will be described. First, the cartridge tray 43 is moved in the arrow G1 direction in FIG. 14 to the pulled-out position. In this state, the cartridge Q is demounted in an arrow H2 direction shown in FIG. 14, so that the demounting operation of the cartridge Q from the apparatus main assembly 102 is completed. By the above-described operations, the cartridge Q is detachably mountable to the apparatus main assembly 102.

Incidentally, in this embodiment, the cleaning 8 is mounted in the cartridge tray 43 in advance, but the constitution is not limited thereto. It is also possible to employ a constitution in which the cleaning unit 8 is disposed in the apparatus main assembly 102 in advance. A process from demounting of the cartridge Q from the packing member 143 until the cartridge Q is mounted into the apparatus main assembly 102 will be described specifically.

<Structure of Packing Member>

A structure of the packing member 146 will be described with reference to FIG. 15.

Incidentally, constituent elements of the packing member 146 similar to those in Embodiment 1 will be omitted from description.

FIG. 15 is a schematic sectional view showing a packing state of the cartridge Q in the packing member 46 in this embodiment.

The packing member 146 is constituted by a frame portion 147, a cap portion 148 and a hinge portion 149. The frame portion 147 and the cap portion 148 are rotatable, relative to each other, after a rotation shaft 149*a* of the hinge portion 149. Each of the frame portion 147, the cap portion 148 are the hinge portion 149 which constitute the packing member 146 is constituted, similarly as in Embodiment 1, by a thin plate (sheet) of plastic (resin material), such as polyethylene terephthalate or polypropylene. As a molding method, the resin material can be molded by vacuum molding, air-pressure molding, vacuum air-pressure molding, drawing (molding), or injection molding.

Further, the packing member 146 includes a connecting portion 146*a* for unpacking the packing member 146. The connecting portion 146*a* is located in a position where it is opposite from the hinge portion 149 in the packing state of the packing member 146.

The frame portion 147 includes a first recessed portion 147*c* having a recessed shape provided with a first opening 147*c*1. Further, the cap portion 148 includes a second recessed portion 148*b* having a recessed shape provided with a second opening 148*b*1. Further, at the frame portion 147 and the cap portion 148, flange portions 147*a* and 148*a* are formed so as to surround the first recessed portion 147*c* and the second recessed portion 148*b*, respectively. The frame portion 147 and the cap portion 148 are connected at the hinge portion 149, thus being integrally molded. Further, the cap portion 148 is capable of being located in a closed position where the cap portion 148 is capable of covering the first opening 147*c*1 of the frame portion 147 (FIGS. 1 and 11) and an open position where the first opening 147*c*1 is open.

Next, the fixing of the cartridge Q in the packing member 146 will be described. The cartridge Q is supported in a first state at the frame portion 147 of the packing member 146. This will be specifically described later. In the first state, the cartridge Q inserted into the packing member 146 through the first opening 147*c*1 is detachably mounted in the packing member 146. Further, in the first state, the cartridge Q is held by the frame portion 147 and the frame portion 147 covers the exposed portion 6*b* of the developing roller 6 of the cartridge Q. Further, in the first state, the exposed portion 6*b* of the developing roller 6 is prevented from contacting an inner surface of the frame portion 147 and the cap portion 148 is rotated, relative to the frame portion 147, about a rotation shaft 149*a* of the hinge portion 149, and a user is capable of gripping the grip portion 145 of the cartridge Q. Further, from the above-described packing state (not shown), the cap portion 148 is rotated, about the rotation shaft 149*a* of the hinge portion 149, toward the frame portion 147, so that the flange portion 148*a* of the cap portion 148 is contacted to the flange portion 147*a* of the frame portion 147 as shown in FIG. 15. Thereafter, the flange portion 47*a* of the frame portion 47 and the flange portion 48*a* of the cap portion 48 which oppose each other are partly or wholly bonded to each other. As a result, as shown in FIG. 15, the first recessed portion 147*c* of the frame portion 147 and the second recessed portion 148*b* of the cap portion 148 form a connecting portion 146*a* in combination, thus creating an accommodating space 146*b* inside the packing member 146, so that the packing member 146 is capable of being accommodated in the accommodating space 146*b*. In this state, the second recessed portion 148*b* of the cap portion 148 covers the entire cartridge Q or a part of the cartridge Q so as to accommodate the grip portion 145 of the cartridge Q which is the substantially rectangular parallelopiped. By the above-described packing, the whole cartridge Q is covered with the frame portion 147 and the cap portion 148 to be placed in the packing state (second state) (FIG. 15).

Next, in the packed state, positional limitation of the cartridge Q by the packing member 146 will be described. In order to effect the positional limitation of the cartridge Q with respect to the X (X1 and X2) direction, a pair of third limiting portions (not shown) formed at inner surfaces of the frame portion 147 is contacted to the third portions to be limited 139*f* and 144*f* of the cartridge Q shown in (a) and (b) of FIG. 13. Accordingly, the positions of the cartridge Q with respect to the X1 and X2 directions are limited in the first state described above. Further, the positional limitation of the cartridge Q with respect to Y1 and Y2 directions and Z2 direction shown in FIG. 15 is effected. For that purpose, the first limiting portions 147*g* and 147*b* formed at the inner surface of the frame portion 148 of the packing member 146 are contacted to first portions to be limited 144*g* and 144*b* shown in (a) and (b) of FIG. 13. Accordingly, the positions of the cartridge Q with respect to the Y1, Y2, and Z directions is limited in the first state described above. Further, as shown in FIG. 15, the second limiting portion 148*c* is formed in the cap portion 148. Further, the second limiting portion 148*c* is formed at a position corresponding to second portion to be limited 129*c* of the cartridge Q in the packing state (second state) of the packing member 146. Further, with respect to the cartridge Q, in the packing state (second state) the second portion to be limited 129*c* contacts the second limiting portion 148*c* of the cap portion 148. As a result, the positional limitation of the cartridge Q in Z1 direction is made. That is, in the first state, the cartridge Q is not limited with respect to the Z1 direction opposite to the direction of gravitation. In the above described packing state (second state), the packing member 146 does not contact the cartridge Q at portions other than the limiting portions 147*b*, 148*c*, and 147*g* and contacts the third portion-to-be-limited 144*f* shown in FIG. 15. For that reason, similarly as in Embodiment 1, the packing member 146 generates elastic deformation and plastic deformation at the portions other than the respective limiting portions when vibration and impact are generated during transportation, so that the packing member 146 is capable of absorbing the vibration and the impact during transportation. Therefore, the packing member 146 does not directly transmit the vibration and the impact during transportation to the developing roller 6 and other process means and thus functions as a protecting member for protecting the cartridge Q. Further, each of the limiting portions of the packing member 146 may be contacted to the cartridge Q at any position if the position is not in a region where the development is to be made by using the developing roller 6 of the cartridge Q. However, when the third portions to be limited 139*b* and 144*b* have high rigidity, the cartridge Q is less broken by the impact or the like during transportation. Further, in the first state, the cartridge Q has already by positionally limited by the frame portion 147 of the packing member 146 with respect to the longitudinal direction Y1, Y2 and Z1 directions. That is, in order to fix the cartridge Q in the packing member 146, when the state of the packing member 146 is changed from the first state to the second state, the cartridge Q is only required to be covered with the cap portion 148, so that an assembling property can be further improved. Further, the limiting portions 147*b*, 148*c*, and 147*g*, and the third portion-to-be-limited 144*f*, are formed in the frame portion 147 and cap portion 148 of the packing member 146 but may also be constituted as separate members.

<Relationship Between Grip Portion and Packing Member>

A positional relationship between the grip portion 145 of the cartridge Q and the packing member 146 will be described with reference to FIG. 15. With respect to the Y direction, as shown in FIG. 15, the closest edge line, to the hinge portion 149, of the cartridge Q is a first edge line 109*a*, and the remotest edge line, from the hinge portion 149, of the cartridge Q is a second edge line 109*b*. Further, a medium line between the first and second edge lines 109*a* and 109*b* is a center line m. In this case, the grip portion 145 is provided in the right side of the center line m in FIG. 15 (in the upstream side of the Y direction). Further, in this case, when the cartridge Q is packed in the packing member 146, the cartridge Q is in an attitude such that the grip portion 145 is disposed in a side opposite from the hinge portion 149 side with respect to the center line m. Further, the demounting operation of the cartridge Q from the packing member 146 is the same as that in Embodiment 1 in which the cartridge P is replaced with the cartridge Q in this embodiment, and therefore will be omitted from description.

Embodiment 3

Next, Embodiment 3 will be described with reference to FIGS. 16 to 20.

<General Structure of Image Forming Apparatus>

First, FIG. 16 is a schematic sectional view of the image forming apparatus in this embodiment.

As shown in FIG. 16, an image forming apparatus 201 is a four color-based full-color laser printer using the electrophotographic image forming process and effects color image formation on a recording material S. The image forming apparatus 201 is of a process cartridge type in which the process cartridge is detachably mountable to an apparatus main assembly 202 and a color image is formed on the recording material S.

In the apparatus main assembly 202, four cartridges 200P consisting of a first cartridge 200PY, a second cartridge 200PM, a third cartridge 200PC and a fourth cartridge 200PK are provided and arranged obliquely with respect to a horizontal direction. The respective first to fourth cartridges 200P have the same electrophotographic process mechanism but contains developers (toners) different in color from one another. To the first to fourth cartridges 200P, a rotational driving force is transmitted from a drive output portion (not shown) of the apparatus main assembly 202. Further, to the first to fourth cartridges 200P, bias voltages (charging bias, developing bias and the like) are supplied from the apparatus main assembly 202 (not shown).

Each of the first to fourth cartridges 200P includes a first frame including a photosensitive drum) 204, and including a charging means and a cleaning means which are used as process means acting on the photosensitive drum 204. The first frame is referred to as a cleaning unit 208.

Further, each of the first to fourth cartridges 200P includes a developing device 209 which is a second frame including a developing means for developing an electrostatic latent image on the photosensitive drum 204.

The cleaning unit 208 and the developing device 209 are connected with each other. As shown in FIG. 18, as the charging means, a charging roller 205 is used. As the cleaning means, a cleaning blade 207 is used. As the developing means, a developer carrying member (hereinafter referred to as a developing roller) 206 is used. A more specific constitution of the cartridges will be described below.

The first process cartridge 200PY accommodates the toner of yellow (Y) and forms the toner image of yellow on the surface of the photosensitive drum 204. The second process cartridge 200PM accommodates the toner of magenta (M) and forms the image of magenta on the surface of the photosensitive drum 204. The process third cartridge 200PC accommodates the toner of cyan (C) and forms the toner image of cyan on the surface of the photosensitive drum 204. The fourth process cartridge 200PK accommodates the toner of black (K) and forms the toner image of black on the surface of the photosensitive drum 204.

As shown in FIG. 16, above the first to fourth process cartridges 200P, a laser scanner unit LB as an exposure means is provided. This laser scanner unit LB outputs laser light Z correspondingly to image information. Then, the surface of the photosensitive drum 204 is subjected to scanning exposure to the laser light Z.

On the first to fourth cartridges 200P an intermediary transfer belt unit 211 as a transfer member is provided. This intermediary transfer belt unit 211 includes a driving roller 213, a turn roller 214 and a tension roller 215, and includes a transfer belt 212 extended and stretched by the rollers. The photosensitive drum 204 of each of the first to fourth process cartridges 200P is contacted to an lower surface of the transfer belt 212 at its upper surface. A resultant contact portion is a primary transfer portion. Inside the transfer belt 212, primary transfer rollers 216 are provided opposed to the associated photosensitive drums 204. Oppositely to the turn roller 214, a secondary transfer roller 217 is provided in contact with the transfer belt 212. A resultant contact portion between the transfer belt 212 and the secondary transfer roller 217 is a secondary transfer portion.

Below the laser scanner unit LB, a sheet feeding unit 218 is provided. This sheet feeding unit 218 includes a sheet feeding tray 219 in which sheets of the recording material S are stacked, and includes a sheet feeding roller 220 and the like.

In an upper left side of the apparatus main assembly 202 in FIG. 16, a fixing unit 221 is provided. At an upper surface of the apparatus main assembly 202, a sheet discharge tray 223 is provided.

On the recording material S, the toner image is fixed by the fixing means provided in the fixing unit 221, and then the recording material S is discharged onto the discharge tray 223.

<Image Forming Operation>

First, a schematic sectional view of the image forming apparatus 201 in this embodiment is shown in FIG. 16.

Next, an operation for forming a full-color image is as follows. The photosensitive drums 204 of the first to fourth cartridges 200P (200PY to 200PK) are rotationally driven at a predetermined speed (in an arrow D direction. The transfer belt 212 provided vertically on the photosensitive drums 204 is also rotationally driven in the same direction (arrow C direction) as the rotational direction of the photosensitive drums 204 (at their contact portions) at a speed corresponding to the speed of the photosensitive drums 204.

The laser scanner unit LB is also driven. In synchronism with the drive of the laser scanner unit LB, the surface of the photosensitive drum 204 of each cartridge 200P is electrically charged to a predetermined polarity and a predetermined potential by the charging roller 205. The scanner unit LB scans and exposes the surface of each photosensitive drum 204 with the laser light Z depending on an associated signal. As a result, the electrostatic latent image depending on the image signal for the associated color is formed on the surface of each photosensitive drum 204. The thus formed electrostatic latent image is developed by the developing roller 206 which is rotationally driven in an arrow E direction at a predetermined speed.

By the electrophotographic image forming process operation as described above, on the photosensitive drum 204 of the first cartridge 200PY, a yellow toner image corresponding to a yellow component for the full-color image is formed. Then, the toner image is primary-transferred onto the transfer belt 212.

Similarly, on the photosensitive drum 204 of the second cartridge 200PM, a magenta toner image corresponding to a magenta component for the full-color image is formed. Then, the toner image is primary-transferred superposedly onto the yellow toner image which has already been transferred on the transfer belt 212.

Similarly, on the photosensitive drum 204 of the third cartridge 200PC, a cyan toner image corresponding to a cyan component for the full-color image is formed. Then, the toner image is primary-transferred superposedly onto the yellow and magenta toner images which have already been transferred on the transfer belt 212.

Similarly, on the photosensitive drum 204 of the fourth cartridge 200PK, a black toner image corresponding to a black component for the full-color image is formed. Then, the toner image is primary-transferred superposedly onto the yellow, magenta and cyan toner images which have already been transferred on the transfer belt 212.

In this way, unfixed toner images of yellow, magenta, cyan and black for the four color-based full-color image are formed on the transfer belt 212.

On the other hand, at predetermined control timing, sheets of the recording material S are separated and fed one by one. The recording material S is introduced into a secondary transfer portion which is a contact portion between the secondary transfer roller 217 and the transfer belt 212 with predetermined control timing. As a result, in a process in which the recording material S is conveyed to the secondary transfer portion, the four color toner images superposed on the transfer belt 212 are collectively transferred onto the surface of the recording material S.

The image forming apparatus 201 in this embodiment is largely different from the image forming apparatuses in Embodiments 1 and 2 in the following two points. A first point is that the cartridges 200P are individually mounted in the apparatus main assembly 202 along the longitudinal direction of the photosensitive drum 204. A second point is that the intermediary transfer unit 211 is disposed on the cartridges 200P with respect to the vertical direction. Therefore, the cartridges 200P are mounted in the apparatus main assembly 202 in a state in which their surfaces are exposed upward.

<Structure of Packing Member>

A structure of the packing member 246 will be described with reference to FIGS. 17 to 20.

Incidentally, constituent elements similar to those in Embodiment 1 will be omitted from description.

FIG. 17 is a schematic perspective view of the packing member 246 in this embodiment, and FIG. 18 is a schematic sectional view showing a packing state of the cartridge 200P in the packing member 246 in this embodiment. FIGS. 19 and 20 is a schematic perspective views each showing an open state of a cap portion 248 of the packing member 246 in which the cartridge 200P is packed.

The packing member 246 is constituted by a frame portion 247, the cap portion 248 and a hinge portion 249. The frame portion 247 and the cap portion 248 are movable (rotatable) relative to each other via the hinge portion 249. Each of the frame portion 247, the cap portion 248 are the hinge portion 249 which constitute the packing member 246 is constituted similarly as in Embodiment 1 by a thin plate (sheet) of plastic (resin material), such as polyethylene terephthalate or polypropylene. As a molding method, the resin material can be molded by vacuum molding, air-pressure molding, vacuum air-pressure molding, drawing (molding), or injection molding.

Further, the packing member 246 includes a connecting portion 246*a* for unpacking the packing member 246. The connecting portion 246*a* is, in a packing state of the packing member 246, located at a position opposite from the hinge portion 249. The connecting portion 246*a* is formed by bonding a flange portion 247*a* of the frame portion 247 and a flange portion 248*a* of the cap portion 248 to each other by welding or the like. When the cap portion 248 is opened, the cap portion 248 can be opened by separating the flange portion 248*a* from the flange portion 247*a* at the connecting portion 246*a*.

Further, the frame portion 247 includes a first recessed portion 247*c* having a recessed shape provided with a first opening 247*c*1. Further, the cap portion 248 includes a second recessed portion 248*b* having a recessed shape provided with a second opening 248*b*1. Further, at the frame portion 247 and the cap portion 248, flange portions 247*a* and 248*a* are formed so as to surround the first recessed portion 247*c* and the second recessed portion 248*b*, respectively. The frame portion 247 and the cap portion 248 are connected at the hinge portion 249, thus being integrally molded. Further, the cap portion 248 is capable of being located in a closed position where the cap portion 248 is capable of covering the first opening 247*c*1 of the frame portion 247 (FIG. 18) and an open position where the first opening 47*c*1 is open (FIGS. 19 and 20).

Next, the fixing of the cartridge 200P in the packing member 246 will be described. The cartridge 200P is, as shown in of FIG. 19, supported in a first state at the frame portion 147 of the packing member 146. This will be specifically described later. In the first state, the cartridge 200P inserted into the packing member 246 through the first opening 247*c*1 is detachably mounted in the packing member 246. Further, in the first state, the cartridge 200P is held by the frame portion 247, and at the frame portion 247, the surface of the photosensitive drum 204 of the cartridge 200P are exposed toward vertically above. Further, in the first state, in order to demount and mount the cartridge 200P with respect to the packing member 246, as shown in FIG. 20, the cleaning unit 208 and the developing device 209 can be gripped. That is, between the cartridge 200P and the packing member 246, spacings 247*h*1 and 247*h*2 through which a user's hand can enter. These spacings 247*h*1 and 247*h*2 are provided between two first limiting portions 247*g*1 (described later) and between two first limiting portions 247*g*2 (described later), respectively, with respect to the longitudinal direction in a state in which they are recessed from the first limiting portions 247*g*1 and 247*g*2. By the spacings 247*h*1 and 247*h*2, even when the user deeply grips the cartridge 200P, the user's hand does not interfere with the packing member 246, so that usability of the mounting and demounting of the cartridge 200P with respect to the packing member 246 is improved.

From the packing state shown in FIG. 19, the cap portion 148 is rotated about the hinge portion 149 toward the frame portion 147, so that the flange portion 148*a* of the cap portion 148 is contacted to the flange portion 147*a* of the frame portion 147 as shown in FIG. 18. Thereafter, the flange portion 147*a* of the frame portion 147 and the flange portion 148*a* of the cap portion 148 are partly or wholly bonded to each other. As a result, as shown in FIG. 18, the first recessed portion 147*c* of the frame portion 147 and the second recessed portion 148*b* of the cap portion 148 form a connecting portion 46*a* in combination, thus creating an accommodating space 46*b* inside the packing member 246 to enable accommodation of the cartridge 200P in the accommodating space 246*b*. In this second state, the second recessed portion 248*b* of the cap portion 248 covers an upper portion of the cartridge 200P while protecting the surface of the photosensitive drum 204. By the above-described packing, the whole cartridge P is covered with the frame portion 47 and the cap portion 48 to be placed in the packing state (second state) (FIG. 18).

Next, in the packed state, positional limitation of the cartridge 200P by the packing member 246 will be described. In order to effect the positional limitation of the cartridge 200P with respect to the X1 and X2 direction, a pair of third limiting portions 247*f*1 and 247*f*2 formed at inner surfaces, of the frame portion 247 is contacted to third portions-to-be-limited 208*f*1 and 208*f*2 of the cartridge 200P shown in FIG. 19. Accordingly, the positions of the cartridge 200P with respect to the X1 and X2 directions are limited in the first state described above. Further, in order to effect the positional limitation of the cartridge 200P with respect to Z2 direction, first limiting portions 247*b*1 and 247*b*2 formed at an inner surface of the frame portion 247 of the packing member 246 are contacted to first portions-to-be-limited 208*a* and 209*a* of the cartridge 200P. Further, although a spacing is somewhat created, first limiting portions 247*g*1 and 248*g*2 provided at the inner surface of the frame portion 247 are used to effect positional limitation with respect to the Y1 and Y2 directions by contact with first portions-to-be-limited 208*c* and 209*c*. Further, as shown in FIG. 18, a second limiting portion 248*c* is formed in the cap portion 148. Further, the second limiting portion 248*c* is formed at a position corresponding to a second portion-to-be-limited 208*b* of the cartridge 200P in the packing state (second state) of the packing member 246. Further, with respect to the cartridge 200P, in the packing state (second state) the second portion-to-be-limited 208*b* contacts the second limiting portion 248*c* of the cap portion 248. As a result, positional limitation of the cartridge 200P with respect to the Z1 direction is made. That is, in the first state, the cartridge 200P is not limited with respect to the Z1 direction opposite to the direction of gravitation. Here, the second portion-to-be-limited 208*b* of the cartridge 200P is a part of a side cover for covering a bearing portion (not shown) for rotatably supporting the photosensitive drum 204, and is provided at each of longitudinal end portions of the cartridge 200P.

In the above-described packing state (second state), the packing member 246 does not contact the cartridge 200P at portions other than the limiting portions shown in FIGS. 18 and 19. For that reason, similarly as in Embodiment 1, the packing member 246 generates elastic deformation and plastic deformation at the portions other than the respective limiting portions when vibration and impact are generated during transportation, so that the packing member 246 is capable of absorbing the vibration and the impact during transportation. Therefore, the packing member 246 does not directly transmit the vibration and the impact during transportation to the photosensitive drum 204 and the process means and thus functions as a protecting member for protecting the cartridge P. Further, each of the limiting portions of the packing member 246 may be contacted to the cartridge 200P at any position except for the photosensitive drum 204 of the cartridge 200P. However, when the third portions-to-be-limited 208*f*1 and 208*f*2 have high rigidity, the cartridge 200P is less broken by the impact or the like during transportation. Further, in the first state, the cartridge 200P has already by positionally limited by the frame portion 247 of the packing member 246 with respect to the longitudinal direction and the Y1, Y2 and Z1 directions. That is, in order to fix the cartridge 200P in the packing member 246, when the state of the packing member 46 is changed from the first state to the second state, the cartridge 200P is only required to be covered with the cap portion 248, so that an assembling property can be further improved.

Embodiment 4

<Structure of Packing Member>

A structure of the packing member 346 in Embodiment 4 will be described with reference to FIGS. 21 to 23. Incidentally, constituent elements, for packing member 346 in this embodiment, similar to those for the packing member 46 in Embodiment will be omitted from description. FIG. 21 is a schematic perspective view of the packing member 346 in this embodiment, and FIG. 22 is a schematic perspective view showing a state (stacking state) in which a plurality of packing members 346 are superposedly stacked. FIG. 23 is a schematic sectional view showing the stacking state in V cross-section.

The packing member 346 is constituted by a frame portion 347, a cap portion 348 and a hinge portion 349. The frame portion 347 and the cap portion 348 are movable (rotatable) relative to each other, via the hinge portion 349. Each of the frame portion 347, the cap portion 348 are the hinge portion 349 which constitute the packing member 346 is constituted similarly as in Embodiment 1, by a thin plate (sheet) of plastic (resin material), such as polyethylene terephthalate or polypropylene. As a molding method, the resin material can be molded by vacuum molding, air-pressure molding, vacuum air-pressure molding, drawing (molding), or injection molding.

Similarly as in Embodiments 1 to 3, the frame portion 347 includes a first recessed portion 347*c* having a recessed shape provided with a first opening 347*c*1 (FIG. 23). Further, the cap portion 348 includes a second recessed portion 348*b* having a recessed shape provided with a second opening 348*b*1 (FIG. 23). Further, at the frame portion 347 and the cap portion 348, flange portions 347*a* and 348*a* are formed so as to surround the first recessed portion 347*c* and the second recessed portion 348*b*, respectively. The frame portion 347 and the cap portion 348 are connected at the hinge portion 349, thus being integrally molded. Then, when the cartridge (not shown) is packed in the packing member 346, the flange portion 347*a* of the frame portion 347 and the flange portion 348*a* of the cap portion 348 are connected to each other by welding or the like, so that the cap portion 348 is placed in the closed position where the cap portion 348 covers a first opening 347*c*1. In an unpacking state of the cap portion 348, as shown in FIG. 21, the flange portion 348*a* is separated from the flange portion 347*a*, so that the cap portion 348 is in an open state with respect to the frame portion 347.

Similarly as in Embodiments 1 to 3, at the first recessed portion 347*c*, first limiting portion 347*b* for limiting a position of the cartridge (not shown) with respect to a direction crossing the longitudinal direction of the cartridge projects from a bottom 237*c* of the first recessed portion 347*c*. Further, similarly as in Embodiments 1 to 3, at the second recessed portion 348*b*, a second limiting portion 238*c* for limiting spacing of the cartridge (not shown) from the first limiting portion 347*b* projects from a bottom 348*b*3 of the second recessed portion 348*b*. Further, at the second recessed portion 348*b*, a fourth limiting portion 348*d* for limiting movement of a developing frame (not shown) of the cartridge projects from a bottom of the second recessed portion 348*b*. Further, as shown in FIGS. 22 and 23, in the state in which the cap portion 348 is open, the plurality of packing members 346 having the same structure are stacked. For that purpose, side surface portions 347*c*1 and 347*c*2 of the first recessed portion 347*c* of the packing member 346 and side surface portions 348*b*1 and 348*b*2 of the second recessed portion 348*b* of the packing member 346 are formed in an inclined shape. Similarly, a side surface portion 347*b*1 of the first limiting portion 347*b*, side surface portions 348*c*1 and 348*c*2 of the second limiting portion 348*c* and side surface portions 348*d*1 and 348*d*2 of the fourth limiting portion 348*d* are formed in an inclined shape. By these inclined surfaces, outer configuration portions of other packing members having the same structure as the packing member 346 are caused to enter the first recessed portion 347*c* and the second recessed portion 348*b* to be stacked and accommodated, so that the plurality of packing members can be placed in the stacking state ST. Accordingly, in the case where the plurality of packing members 347 in which the cartridges are not packed are transported or stored, the packing members 346 can be superposed and stacked by being caused to enter the first recessed portion 347*c* and the second recessed portion 348*b*, so that the stacking state is effective in space saving.

Further, in this embodiment, the constitution in which the second recessed portion 348*b* is provided in the cap portion 348 has been described, but the packing member 346 may also have a constitution in which the cartridge is accommodated in a recessed portion which is not provided in the cap portion but is provided only in the frame portion.

Embodiment 5

Next, Embodiment 5 will be described.

First, in the embodiments described above, as shown in FIGS. 28 and 29, a constitution in which connection between a first flange portion 647*a* of a frame portion 647 and a second flange portion 648*a* of a cap portion 648 is made by welding at welding portions 646*a*1 and 646*a*2 is shown. When the cap portion 648 of the packing member 646 is opened, as shown in FIG. 29, the cap portion 648 is separated from the frame portion 647 at each of the welding portions 646*a*1 and 646*a*2. That is, the welding portions

646*a*1 and 646*a*2 are required to be separated into a connecting portion 646*a*12 and a portion-to-be-connected 646*a*11 and into a connecting portion 646*a*22 and a portion-to-be-connected 646*a*21, respectively. In this constitution, for convenience of explanation, the cartridge to be packed in the packing member 646 is omitted from illustration.

With respect to the packing member 646, in order to prevent the cap portion 648 from opening by the vibration and the impact during transportation, there is a need to set a connecting force of each of the welding portions 646*a*1 and 646*a*2. However, in the case of the connection by welding, a variation depending on a manufacturing condition or the like is large, and therefore in some cases, a force when the user opens the cap portion 648 becomes large.

Therefore, in Embodiment 5, a packing member capable of protecting the cartridge from the vibration and the impact during transportation with reliability and capable of easily controlling an opening (unpacking) force of the cap portion to facilitate an opening operation of the cap portion is provided.

<Structure of Packing Member>

A constitution of a packing member 446 in Embodiment 5 will be described with reference to FIGS. 24 and 25.

Incidentally, constituent elements similar to those for the packing member 46 in Embodiment 1 will be omitted from description. Also the cartridge to be packed in the packing member 446 will be omitted from description.

As shown in FIG. 24, the packing member 446 accommodates the cartridge (not shown) by a frame portion 447 and a cap portion 448, and the frame portion 447 and the cap portion 448 are connected to each other by a welding portion 446*a*1. The welding portion 446*a*1 is formed on each of a first flange 447*a* provided at a periphery of a first opening 447*c* of the frame portion 447 and a second flange 448*a* provided at a periphery of a second opening 448*c* of the cap portion 448. Another welding portion 446*a*2 provided opposite from the welding portion 446*a*1 with respect to the longitudinal direction of the packing member 446 has the same structure as the welding portion 446*a*1.

However, in FIG. 24, a connecting portion 448*h* including the welding portion 446*a*1 is connected to the second flange 448*a* via a cut portion 460*a* which is perforations. Then, when the cap portion 448 of the packing member 446 is opened, as shown in FIG. 25, the connecting portion 448*h* is separated from the second flange 448*a* by the cut portion 460*a*, and remains on the first flange 447*a*. Similarly, also with respect to a connecting portion 448*k* provided opposed from the connecting portion 448*h* with respect to the longitudinal direction of the packing member 446, in FIG. 24, the connecting portion 448*k* is connected to the second flange 448*a* via a cut portion 460*b* which is perforations. Then, when the cap portion 448 is opened, as shown in FIG. 25, the connecting portion 448*k* is separated from the second flange 448*a* by the cut portion 460*b*, and remains on the first flange 447*a*. By adjusting a size, a spacing of the cut portions 460*a* and 460*b*, i.e., a slit side and a slit interval, it becomes easy to control a force for separating each of the connecting portions 448*h* and 448*k* from the cap portion 448. That is, it becomes easy to adjust the force when the cap portion 448 is opened. Accordingly, compared with the force when the cap portion 648 of the packing member 646 shown in FIGS. 28 and 29 is opened, it becomes possible to reduce the force when the cap portion 448 of the packing member 446 is opened and possible to set the force at a connecting force capable of preventing the cap portion 448 from opening due to the vibration and the impact during transportation. Incidentally, when the force for opening the cap portion 448 is measured, a force gage is mounted on the second flange 448*a* at a longitudinal central portion and then the cap portion 448 is pulled, thus measuring the force.

Further, in this embodiment, the constitution in which the connecting portions 448*h* and 448*k* provided at the cap portion 448 are separated from the cap portion 448 by the cut portions 460*a* and 460*b* was described. However, it is also possible to employ a constitution in which the cut portions are provided in the first flange 447*a* of the frame portion 447 and when the cap portion 448 is opened, the connecting portion as a part of the frame portion is separated from the first flange 447*a*. Further, in the above constitution, the connecting portion was formed by welding. However, the connecting portion may also be formed by using an adhesive, a double-side tape, hooking, staple, or the like, and may also be provided at a plurality of positions. Further, a shape, a dimension and a position of the connecting portion may arbitrarily be selected if the above-described effect is obtained.

Embodiment 6

Next, Embodiment 6 will be described with reference to FIGS. 26 and 27.

In Embodiment 5, the constitution in which the cut portion was provided at a part of the second flange 448*a* of the cap portion 448 was described. In this embodiment, as shown in FIG. 26, cut portions 560*a* and 560*b* provided at a cap portion 548 are disposed along a second flange 548*a* of the cap portion 548 and a recessed portion 548*b* of the cap portion 548. Further, the cap portion 548 is connected to a frame portion 547 at welding portions 546*a*1 to 546*a*3 and 546*b*1 to 546*b*3. That is, it is also possible to employ a constitution in which when the cap portion 548 is opened, a first connecting portion 548*h* and a second connecting portion 548*k* remain on the frame portion 547 while including a part of a recessed portion 548*b* of the cap portion 548. Naturally, the first connecting portion 548*h* and the second connecting portion 548*k* have a size such that they do not obstruct the cartridge when the cartridge is demounted from the packing member 546. An effect in this embodiment is the same as that in Embodiment 5 and therefore will be omitted from description.

Incidentally, in Embodiments 5 and 6, as the bonding means, welding was used. However, the bonding means may also be an adhesive, a double-side tape, hooking, a staple or the like. Further, there is no problem in terms of function even when a shape, a dimension, the number and a position of the connecting means are arbitrarily changed.

INDUSTRIAL APPLICABILITY

As described hereinabove, according to the present invention, it is possible to protect the cartridge from the vibration and impact during transportation with a simpler constitution.

The invention claimed is:

1. A packing member for packing a cartridge that includes a photosensitive drum on which an electrostatic latent image is to be formed and is detachably mountable to an image forming apparatus, wherein said packing member is molded with a thin resin material plate, and said packing member comprises:

(i) a frame portion including (a) an opening as an entrance for the cartridge, (b) a recessed portion for accommodating the cartridge, and (c) a first limiting portion for limiting a position of the cartridge with respect to a direction perpendicular to a longitudinal direction of the cartridge, the first limiting portion being a plurality of surfaces with an interval therebetween larger than a width of the cartridge with respect to the direction perpendicular to the longitudinal direction of the cartridge; and (ii) a cap portion for openably covering the opening, wherein said cap portion includes a second limiting portion for limiting movement of the cartridge to a position where said first limiting portion is capable of limiting movement of the cartridge, and wherein said first limiting portion and said second limiting portion contact portions of the cartridge excluding a region of the photosensitive drum where the electrostatic latent image is to be formed.

2. A packing member according to claim 1, said packing member being formed by subjecting the thin resin material plate to vacuum air pressure molding.

3. A packing member according to claim 1, wherein said cap portion includes a second opening as an entrance for the cartridge and a second recessed portion for forming a space for accommodating the cartridge together with said recessed portion when the opening is covered.

4. A packing member according to claim 3, wherein said second limiting portion accommodates a grip portion, provided on the cartridge, where the cartridge is to be gripped.

5. A packing member according to claim 3, wherein said packing member comprises an inclined surface, provided on an inner surface of each of said recessed portion and said second recessed portion and inclined to extend outwardly as it approaches the opening, so as to stack an outer configuration portion of another packing member, having the same construction as said packing member, on said second recessed portion in a state in which said cap portion is opened.

6. A packing member according to claim 1, wherein said cap portion is integrally molded with said frame portion so as to be movable to a closed position in which the opening is covered and to an open position in which the opening is open.

7. A packing member according to claim 1, wherein said cap portion includes a limiting portion for limiting movement of the cartridge in the longitudinal direction.

8. A packing member according to claim 1, wherein the longitudinal direction is an axial direction of the photosensitive drum.

9. A packing member according to claim 8, wherein said first limiting portion is configured to positionally limit the cartridge so as to prevent a surface of the photosensitive drum from contacting an inner surface of said recessed portion.

10. A packing member according to claim 1, wherein said frame portion includes a flange portion, provided outside the opening, for connecting to said cap portion in a state in which said cap portion is located at a closed position.

11. A packing member according to claim 1, wherein, when the cartridge is mounted in said packing member, said frame portion is structured to form a spacing for permitting gripping of the cartridge from a direction crossing the longitudinal direction of the cartridge.

12. A packing member according to claim 1, wherein the cartridge comprises:

a first frame for supporting the photosensitive drum on which the electrostatic latent image is to be formed; and a second frame for supporting a developing roller for developing the electrostatic latent image, said second frame being capable of moving relative to said first frame and capable of moving the developing roller toward and away from the photosensitive drum, wherein said frame portion includes a third limiting portion for limiting movement of the developing roller away from the photosensitive drum by entering between the first frame and the second frame when said cap portion is located at a closed position in which the opening is covered.

13. A packing member according to claim 1, wherein said packing member comprises an inclined surface, provided on an inner surface of said recessed portion and inclined to extend outwardly as it approaches the opening, so as to stack another packing member, having the same construction as said packing member, on said recessed portion in a state in which said cap portion is opened.

14. A cartridge, including a photosensitive drum on which an electrostatic latent image is to be formed, packed in a packing member, and detachably mountable to an image forming apparatus, wherein said packing member is molded with a thin resin material plate and said packing member comprises:

(i) a frame portion including (a) an opening as an entrance for said cartridge, (b) a recessed portion for accommodating said cartridge, and (c) a first limiting portion for limiting a position of said cartridge with respect to a direction perpendicular to a longitudinal direction of said cartridge, the first limiting portion being a plurality of surfaces with an interval therebetween larger than a width of said cartridge with respect to the direction perpendicular to the longitudinal direction of said cartridge; and (ii) a cap portion for openably covering the opening, wherein said cap portion includes a second limiting portion for limiting movement of said cartridge to a position where said first limiting portion is capable of limiting movement of said cartridge, wherein in a state in which said cap portion is mounted on said frame portion so as to cover the opening, said cartridge is positionally limited by said first limiting portion and said second limiting portion which contact portions of said cartridge excluding a region of said photosensitive drum where the electrostatic latent image is to be formed.

15. A cartridge according to claim 14, wherein said packing member is formed by subjecting said thin resin material plate to vacuum air pressure molding.

16. A cartridge according to claim 14, wherein said cap portion includes a second recessed portion for forming a space for accommodating said cartridge together with said recessed portion when the opening is covered.

17. A cartridge according to claim 16, wherein said second limiting portion accommodates a grip portion, provided on said cartridge, where said cartridge is to be gripped.

18. A cartridge according to claim 14, wherein said cap portion is integrally molded with said frame portion so as to be movable to a closing position in which the opening is covered and to an open position in which the opening is open.

19. A cartridge according to claim 14, wherein said cap portion includes a limiting portion for limiting movement of said cartridge in the longitudinal direction.

20. A cartridge according to claim 14, wherein the longitudinal direction is an axial direction of said photosensitive drum.

21. A cartridge according to claim 20, wherein said first limiting portion is configured to positionally limit said cartridge so as to prevent a surface of said photosensitive drum from contacting an inner surface of said recessed portion.

22. A cartridge according to claim 14, wherein said frame portion includes a flange portion, provided outside the opening, for connecting to said cap portion in a state in which said cap portion is located at a closed position.

23. A cartridge according to claim 14, wherein, when said cartridge is mounted in said packing member, said cartridge is structured to form a spacing, for permitting gripping of said cartridge, from a direction crossing the longitudinal direction of said cartridge.

24. A cartridge according to claim 14, further comprising:

a first frame for supporting said photosensitive drum on which the electrostatic latent image is to be formed; and a second frame for supporting a developing roller for developing the electrostatic latent image, said second frame being capable of moving relative to said first frame and capable of moving said developing roller toward and away from said photosensitive drum, wherein said frame portion includes a third limiting portion for limiting movement of said developing roller away from said photosensitive drum by entering between said first frame and said second frame when said cap portion is located at a closed position in which the opening is covered.

25. A packing member for packing a cartridge that includes a developing roller for developing an electrostatic latent image and is detachably mountable to an image forming apparatus, wherein said packing member is molded with a thin resin material plate, said packing member comprising:

(i) a frame portion including an opening as an entrance for the cartridge, a recessed portion for accommodating the cartridge, and a first limiting portion for limiting a position of the cartridge with respect to a direction perpendicular to a longitudinal direction of the cartridge, the first limiting portion being a plurality of surfaces with an interval therebetween larger than a width of the cartridge with respect to the direction perpendicular to the longitudinal direction of the cartridge; and (ii) a cap portion for openably covering the opening, wherein said cap portion includes a second limiting portion for limiting movement of the cartridge to a position where said first limiting portion is capable of limiting movement of the cartridge, and wherein said first limiting portion and said second limiting portion contact portions of the cartridge excluding an exposed portion of the developing roller.

26. A packing member according to claim 25, said packing member being formed by subjecting the thin resin material plate to vacuum air pressure molding.

27. A packing member according to claim 25, wherein said cap portion includes a second opening as an entrance for the cartridge and a second recessed portion for forming a space for accommodating the cartridge together with said recessed portion when the opening is covered.

28. A packing member according to claim 27, wherein said second limiting portion accommodates a grip portion, provided on the cartridge, where the cartridge is to be gripped.

29. A packing member according to claim 27, wherein said packing member comprises an inclined surface, provided on an inner surface of said second recessed portion and inclined to extend outwardly as it approaches the opening, so as to stack another packing member, having the same constitution as said packing member, said second recessed portion in a state in which said cap portion is opened.

30. A packing member according to claim 25, wherein said cap portion is integrally molded with said frame portion so as to be movable to a closed position in which the opening is covered and to an open position in which the opening is open.

31. A packing member according to claim 25, wherein said cap portion includes a limiting portion for limiting movement of the cartridge in the longitudinal direction.

32. A packing member according to claim 25, wherein the longitudinal direction is an axial direction of the developing roller.

33. A packing member according to claim 32, wherein said first limiting portion is configured to positionally limit the cartridge so as to prevent a surface of the developing roller from contacting an inner surface of said recessed portion.

34. A packing member according to claim 32, wherein said second limiting portion is configured to limit the movement of the cartridge so as to prevent a surface of the developing roller from contacting an inner surface of said cap portion.

35. A packing member according to claim 25, wherein said frame portion includes a flange portion, provided outside the opening, for connecting said cap portion in a state in which said cap portion is located at a closed position.

36. A packing member according to claim 25, wherein, when the cartridge is mounted in said packing member, said frame portion is structured to form a spacing, for permitting gripping of the cartridge, from a direction crossing the longitudinal direction of the cartridge.

37. A packing member according to claim 25, wherein the cartridge comprises:

a first frame for supporting a photosensitive drum on which the electrostatic latent image is to be formed; and a second frame for supporting a developing roller for developing the electrostatic latent image, said second frame being capable of moving relative to said first frame and capable of moving the developing roller toward and away from the photosensitive drum, wherein said frame portion includes a third limiting portion for limiting movement of the developing roller away from the photosensitive drum by entering between the first frame and the second frame when said cap portion is located at a closed position in which the opening is covered.

38. A packing member according to claim 25, wherein said packing member comprises an inclined surface, provided on an inner surface of said recessed portion and inclined to extend outwardly as approaches the opening, so as to stack another packing member having the same constitution as said packing member, on said recessed portion in a state in which said cap portion is opened.

39. A cartridge, including a developing roller for developing an electrostatic latent image, packed in a packing member, and detachably mountable to an image forming apparatus, wherein said packing member is molded with a thin resin material plate, said packing member comprising:

(i) a frame portion including (a) an opening as an entrance for said cartridge, (b) a recessed portion for accommodating said cartridge, and (c) a first limiting portion for limiting a position of said cartridge with respect to a direction perpendicular to a longitudinal direction of said cartridge, the first limiting portion being a plurality of surfaces with an interval therebetween larger than a width of said cartridge with respect to the direction perpendicular to the longitudinal direction of said cartridge; and (ii) a cap portion for openably covering the opening, wherein said cap portion includes a second limiting portion for limiting movement of said cartridge to a position where said first limiting portion is capable of limiting movement of said cartridge, wherein, in a state in which said cap portion is mounted on said frame portion so as to cover the opening, said cartridge is positionally limited by said first limiting portion and said second limiting portion which contact portions of said cartridge excluding an exposed portion of the developing roller.

40. A cartridge according to claim 39, wherein said packing member is formed by subjecting said thin resin material plate to vacuum air pressure molding.

41. A cartridge according to claim 39, wherein said cap portion includes a second recessed portion for forming a space for accommodating said cartridge together with said recessed portion when the opening is covered.

42. A cartridge according to claim 41, wherein said second limiting portion accommodates a grip portion, provided on said cartridge, where said cartridge is to be gripped.

43. A cartridge according to claim 39, wherein said cap portion is integrally molded with said frame portion so as to be movable to a closing position in which the opening is covered and to an open position in which the opening is open.

44. A cartridge according to claim 39, wherein said cap portion includes a limiting portion for limiting movement of said cartridge in the longitudinal direction.

45. A cartridge according to claim 39, wherein the longitudinal direction is an axial direction of said developing roller.

46. A cartridge according to claim 45, wherein said first limiting portion is configured to positionally limit said cartridge so as to prevent a surface of the developing roller from contacting an inner surface of said recessed portion.

47. A cartridge according to claim 45, wherein said second limiting portion is configured to limit movement of said cartridge so as to prevent a surface of said developing roller from contacting an inner surface of said cap portion.

48. A cartridge according to claim 39, wherein said frame portion includes a flange portion, provided outside the opening, for connecting to said cap portion in a state in which said cap portion is located at a closed position.

49. A cartridge according to claim 39, wherein, when said cartridge is mounted in said packing member, said cartridge is structured to form a spacing, for permitting gripping of said cartridge, from a direction crossing the longitudinal direction of said cartridge.

50. A cartridge according to claim 39, further comprising:

a first frame for supporting a photosensitive drum on which the electrostatic latent image is to be formed; and a second frame for supporting a developing roller for developing the electrostatic latent image, said second frame being capable of moving relative to said first frame and capable of moving said developing roller toward and away from said photosensitive drum, wherein said frame portion includes a third limiting portion for limiting movement of said developing roller away from said photosensitive drum by entering between said first frame and said second frame when said cap portion is located at a closed position in which the opening is covered.

* * * * *